US011482376B2

(12) United States Patent
Yamauchi

(10) Patent No.: US 11,482,376 B2
(45) Date of Patent: Oct. 25, 2022

(54) IGNITION COIL PROVIDED WITH CORE COVER INCLUDING SUPPORTING STRUCTURE

(71) Applicant: DENSO CORPORATION, Kariya (JP)

(72) Inventor: Takashi Yamauchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 221 days.

(21) Appl. No.: 16/896,621

(22) Filed: Jun. 9, 2020

(65) Prior Publication Data

US 2020/0395171 A1 Dec. 17, 2020

(30) Foreign Application Priority Data

Jun. 11, 2019 (JP) ..... JP2019-108774

(51) Int. Cl.
*H01F 38/00* (2006.01)
*H01F 38/12* (2006.01)
*F02P 3/055* (2006.01)

(52) U.S. Cl.
CPC ..... *H01F 38/12* (2013.01); *F02P 3/055* (2013.01); *H01F 2038/122* (2013.01)

(58) Field of Classification Search
CPC ..... H01F 38/12; H01F 2038/122; H01F 27/263; H01F 27/266; H01F 27/325; F02P 3/055; F02P 3/02
See application file for complete search history.

(56) References Cited

U.S. PATENT DOCUMENTS 5,416,459 A * 5/1995 Ida ..... H01F 38/12 336/107
5,487,676 A * 1/1996 Maruyama ..... F02P 3/02 324/402
6,208,231 B1 * 3/2001 Oosuka ..... H01F 27/327 336/107
6,231,394 B1 * 5/2001 Schnell ..... G06K 7/0021 439/862
6,332,458 B1 * 12/2001 Shimada ..... F02P 11/00 123/634
6,343,595 B1 * 2/2002 Nakabayashi ..... F02P 3/02 123/634
6,747,540 B1 * 6/2004 Nakase ..... H01F 27/363 336/107
9,897,064 B2 * 2/2018 Deguchi ..... F02P 23/00
10,895,240 B2 * 1/2021 Kondo ..... F02P 3/02
2001/0049231 A1 * 12/2001 Bricaud ..... H01R 13/2442 439/630

(Continued)

FOREIGN PATENT DOCUMENTS

JP 2017-045760 3/2017

*Primary Examiner* — Phutthiwat Wongwian
*Assistant Examiner* — Sherman D Manley
(74) *Attorney, Agent, or Firm* — Nixon & Vanderhye P.C.

(57) ABSTRACT

An ignition coil includes a primary coil and a secondary coil magnetically coupled from each other; a core cover disposed around the primary coil and the secondary coil; and an outer peripheral core supported by the core cover. The core cover includes a pair of support portions that support the outer peripheral core; and at least one of the pair of support portions includes a flexible portion that elastically presses the outer peripheral core, the flexible portion having flexibility in an arrangement direction separating the pair of support portions.

4 Claims, 17 Drawing Sheets

(56) References Cited

U.S. PATENT DOCUMENTS

| | | | | |
|---|---|---|---|---|
| 2002/0057179 | A1* | 5/2002 | Shimada | H01F 27/327<br>336/208 |
| 2002/0175796 | A1* | 11/2002 | Kawai | H01F 38/12<br>336/96 |
| 2003/0080843 | A1* | 5/2003 | Wada | H01F 38/12<br>336/90 |
| 2005/0077990 | A1* | 4/2005 | Kawai | H01F 27/327<br>336/90 |
| 2005/0208826 | A1* | 9/2005 | Suzuki | H01R 24/58<br>439/578 |
| 2009/0033451 | A1* | 2/2009 | Akimoto | H01F 38/12<br>336/96 |
| 2009/0071454 | A1* | 3/2009 | Fujiyama | H01F 38/12<br>123/634 |
| 2012/0299679 | A1* | 11/2012 | Kobayashi | H01F 38/12<br>336/212 |

* cited by examiner

IGNITION COIL PROVIDED WITH CORE COVER INCLUDING SUPPORTING STRUCTURE

CROSS-REFERENCE TO RELATED APPLICATION

This application is based on and claims the benefit of priority from earlier Japanese Patent Application No. 2019-108774 filed Jun. 11, 2019, the description of which is incorporated herein by reference.

BACKGROUND

Technical Field

The present disclosure relates to an ignition coil.

Description of the Related Art

An example of a conventional ignition coil includes a primary coil and a secondary coil which are mutually magnetically coupled, and an outer peripheral core having an annular shape formed surrounding the primary coil and the secondary coil. The outer peripheral core is supported by a core holder.

SUMMARY

As one aspect of the present disclosure, an ignition coil is provided including a primary coil and a secondary coil magnetically coupled from each other; a core cover disposed around the primary coil and the secondary coil; and an outer peripheral core supported by the core cover. The core cover includes a pair of support portions that support the outer peripheral core, and at least one of the pair of support portions includes a flexible portion that elastically presses the outer peripheral core, the flexible portion having a flexibility in an arrangement direction along which the pair of support portions is arranged.

DETAILED DESCRIPTION OF THE PREFERRED EMBODIMENTS

Figure 1:
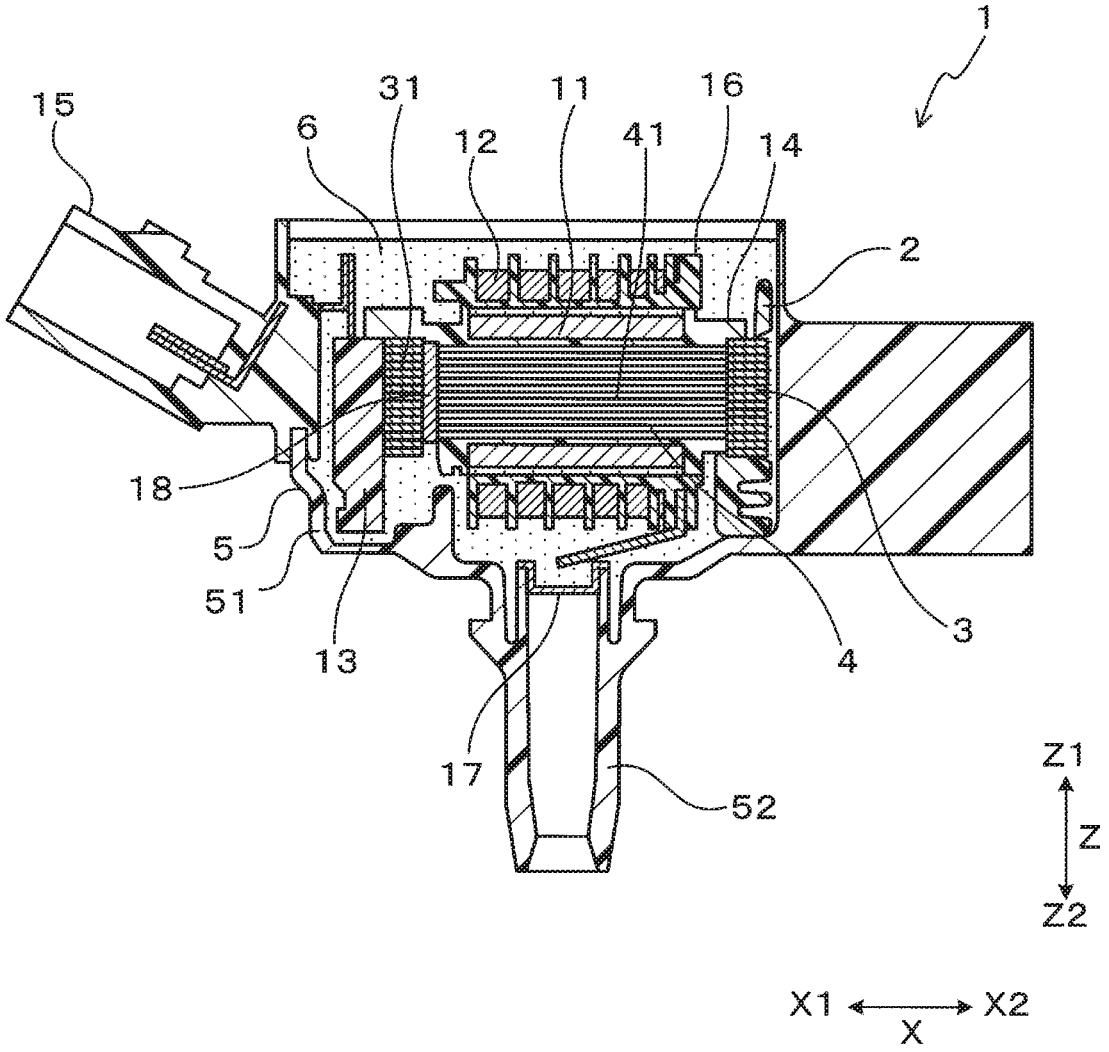
FIG. 1 is a diagram showing a cross-sectional view of an ignition coil according to a first embodiment of the present disclosure.

According to the above-mentioned conventional ignition coil, specifically, Japanese Patent Application Laid-Open Publication Number 2017-45760 discloses a core holder including a pair of bottom plate portions and a coupling side plate portion. The pair of bottom plate portions hold the outer peripheral core from both sides of the annular outer peripheral core in an opening direction, and the coupling side plate portion couples the inner peripheral side edges of the bottom plate portion in the opening direction and faces the inner peripheral surface of the outer peripheral core.

However, according to the ignition coil disclosed by the above patent literature, a problem arises that the outer peripheral core cannot be disposed between the pair of bottom plate portions as the dimension of the outer peripheral core in the opening direction becomes larger than an interval between the pair of bottom plate portions in the opening direction because of the manufacturing tolerance or the like. Since it is difficult to reduce the tolerance in view of cost and manufacturability, the ignition coil according to the above-described patent literature should be improved in order to enhance ability of the assembly of the core with the core cover.

Hereinafter, with reference to the drawings, embodiments of the present disclosure will be described.

First Embodiment

With reference to FIGS. 1 to 12, an ignition coil according to the first embodiment will be described. As shown in FIG.

1, an ignition coil 1 according to the first embodiment is provided with a primary coil 11 and a secondary coil which are magnetically coupled from each other, a core cover 2 disposed around the primary and secondary coils, and an outer peripheral core 3 supported by the core cover 2.

As shown in FIGS. 2 to 8, the core cover 2 includes a pair of support portions 21 that support the outer peripheral core 3. At least one of the pair of support portions 21 include a flexible portion 211 that elastically presses the outer peripheral core 3, the flexible portion 211 having a flexibility in a direction along which the pair of support portions 21 is arranged. Hereinafter, the first embodiment will be described in more detail.

Figure 7:
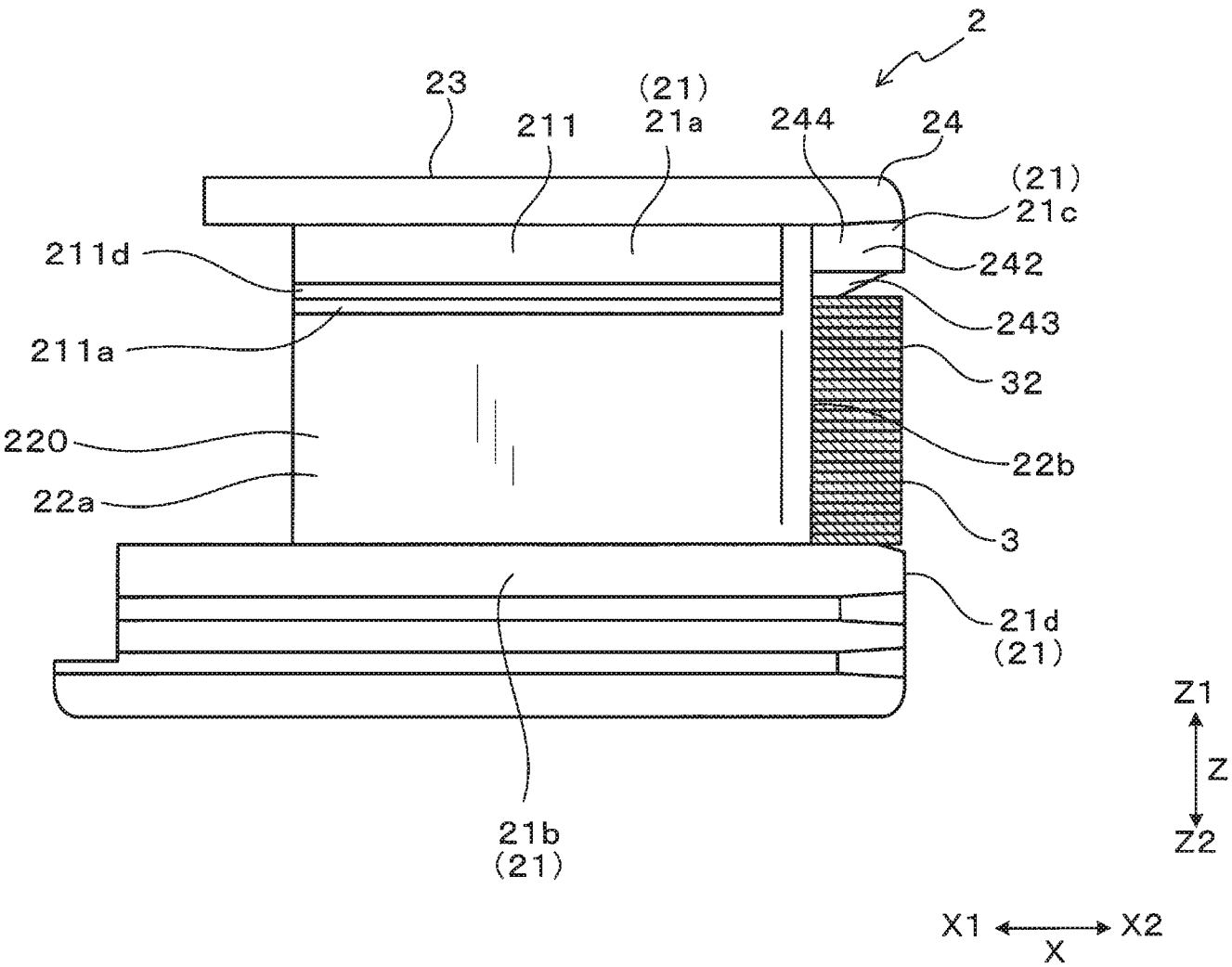
FIG. 7 is a diagram showing a side view of the core cover according to the first embodiment.
Figure 8:
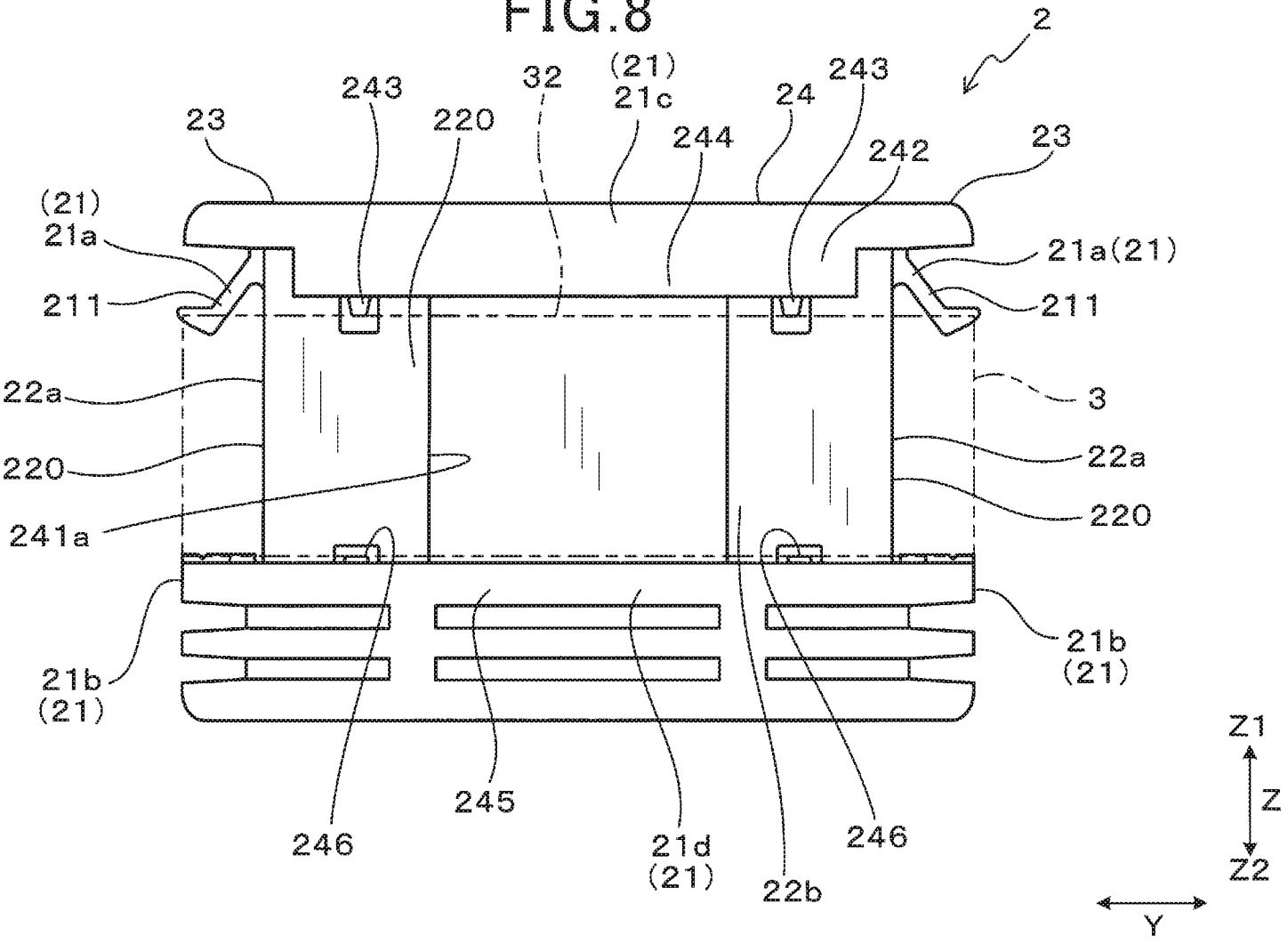
FIG. 8 is a diagram showing a rear view of the core cover when viewed from a rear side according to the first embodiment.

Note that as shown in FIG. 7, the outer periphery 3 only shows a cross section of a rear side portion 32 which will be described later. In FIG. 8, the outline of the outer peripheral core 3 is shown with a two-dot chain line.

Note that a X direction is defined as a direction along which the winding axis of the primary coil 11 and the secondary coil 12 extends. Also, as shown in FIG. 1, a front side X1 is defined as an one side of the X direction in which a later-described ignitor 13 is provided, and a rear side X2 is defined as the other side of the X direction. The direction along which the pair of support portions 21 is arranged, is a direction orthogonal to the X direction, which will be referred to as a Z direction hereinafter. Further, an upper side Z1 is defined as an one side of the Z direction in which a later-described case 5 is opened, and a lower side Z2 is defined as the other side of the Z direction in which a high voltage tower portion 52 in the case 5 is protruded. Note that expressions of front/back, and upper/lower are used for sake of convenience and do not limit the orientation of the ignition coil 1 with respect to the internal combustion engine. Moreover, a direction orthogonal to both of the X direction and the Z direction is defined as the Y direction.

The ignition coil 1 according to the first embodiment can be utilized for a vehicle, an internal combustion engine for a co-generation or the like. The ignition coil 1 is connected to a spark plug (not shown) provided in an internal combustion engine, and used as a means for applying high voltage to the spark plug.

Figure 9:
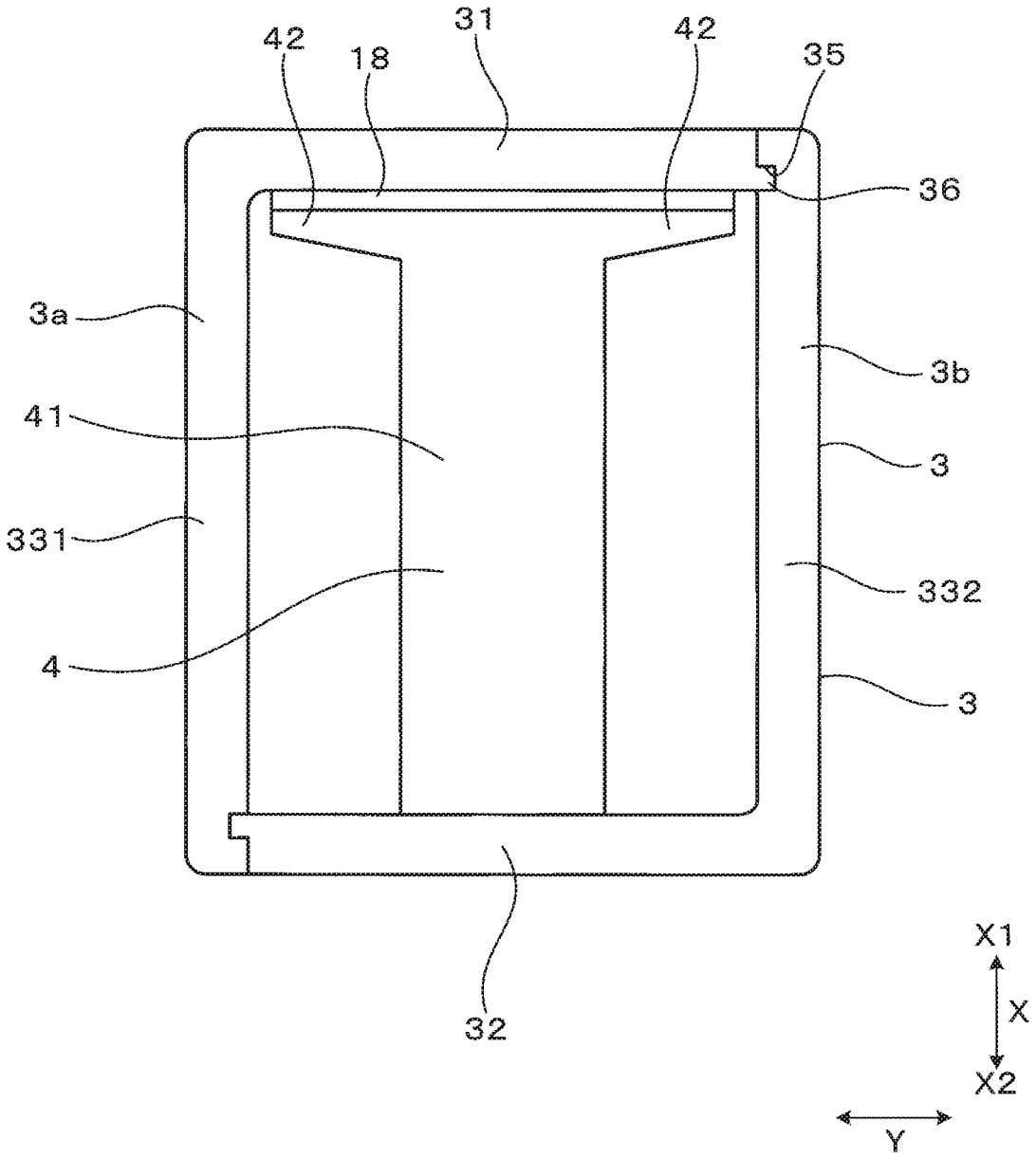
FIG. 9 is a diagram showing a plan view of a center core, a magnet, and the outer peripheral core according to the first embodiment.

As shown in FIG. 9, the outer peripheral core 3 has an annular rectangular shape when viewed from the Z direction. The respective upper surface and the lower surface of the outer peripheral core 3 are formed on a surface orthogonal to the Z direction to be flush with each other. The outer peripheral core 3 is provided with a front side portion 31, a rear side portion 32, and a pair of side portions 331 and 332.

The front side portion 31 and the rear side portion 32 are each formed in a rectangular shape having thickness in the X direction.

The pair of side portions 331 and 332 connects one sides of the front side portion 31 and the rear side portion 32 and connects the other sides of the front side portion 31 and the rear side portion 32. The pair of side portions 331 and 332 are each formed in a rectangular shape having thickness in the Y direction, and mutually face in the Y direction. Note that a reference number 331 is applied to the side portion of the later-described first divided core 3*a* and a reference number 332 is applied to the side portion of the later-described second divided core 3*b*.

The outer peripheral core 3 is divided two portions in the circumferential direction. In other words, the first divided core 3*a* and the second divided core 3*b* each having an L-shape when viewed from the Z direction are combined to form the outer peripheral core 3 in annular shape.

The first divided core 3*a* is composed of the front side portion 31 and one of the pair of side portions 331 and 332, and the second divided core 3*b* is composed of the rear side portion 32 and the other of the pair of side portions 331 and 332. The first divided core 3*a* and the second divided core 3*b* have the same shape. The first divided core 3*a* and the second divided core 3*b* are each formed having a thickness in the Z direction, and composed of coated steel plates laminated in the Z direction, in which both sides in the Z direction are coated with an insulation material.

Figure 2:
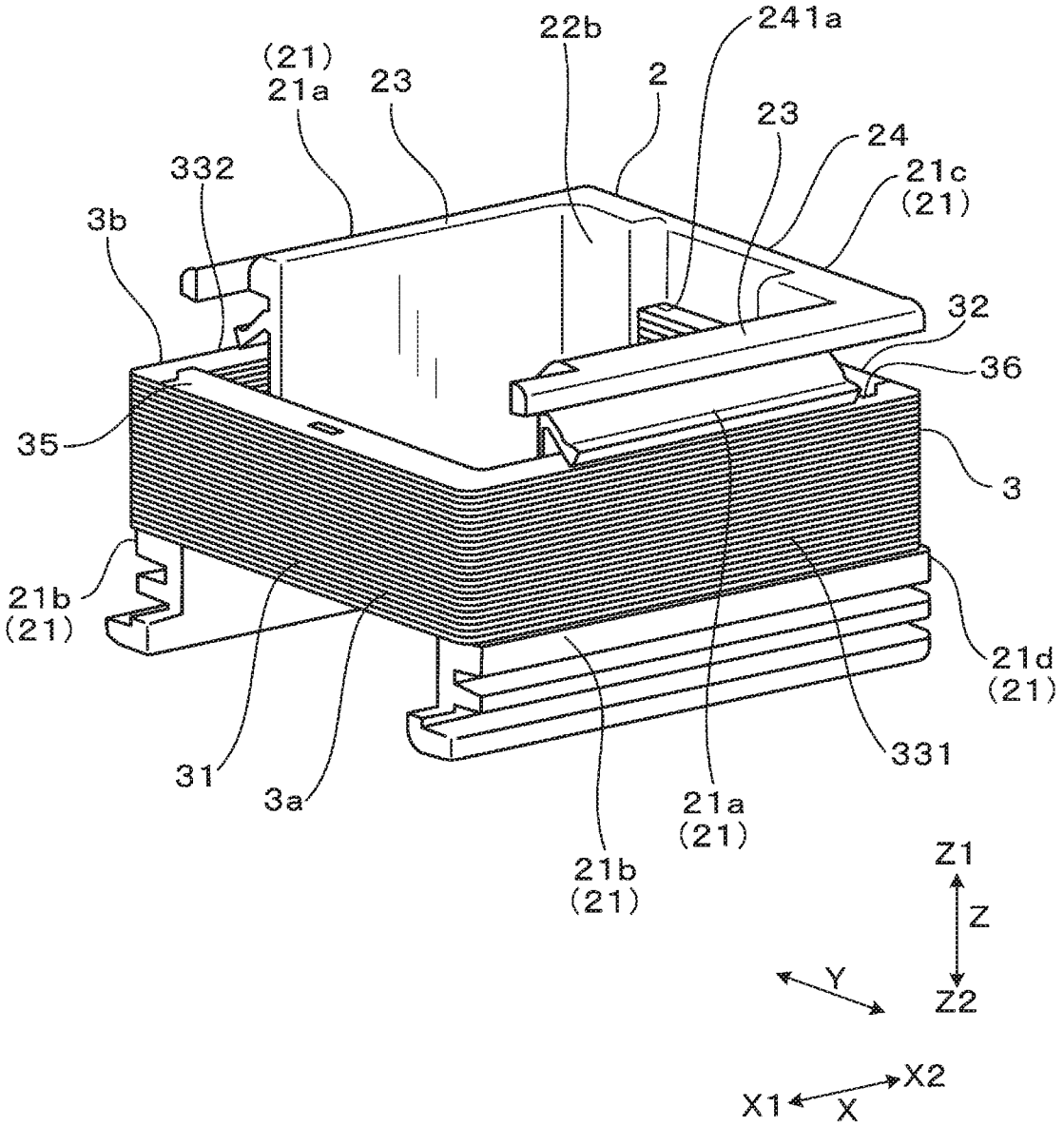
FIG. 2 is a diagram showing a perspective view of a core cover and an outer peripheral core according to the first embodiment.

As shown in FIGS. 2 and 9, the first divided core 3*a* includes, at end portions of the front side portion 31 in the opposite side of the side portions 331 and 332, an convex assembly 35 in which a part of the end face of the front side portion 31 in the Y direction protrudes in the Y direction. Moreover, the first divided core 3*a* includes, at end portions of the side portions 331 and 332 in the opposite side of the front side portion 31, an concave assembly 36 in which a part of the end face is concaved in the Y direction at a portion facing a protruded side of the front side portion 31. In the first divided core 3*a*, each of the convex assembly 35 and the concave assembly 36 is formed entirely in the first divided core 3*a* in the Z direction.

The second divided core 3*b* includes an convex assembly 35, at end portions of the rear side portion 32 in the opposite side of the side portions 331 and 332, an convex assembly 35 in which a part of the end face of the front side portion 31 in the Y direction protrudes in the Y direction. Also, the second divided core 3*b* includes, at end portions of the side portions 331 and 332 in the opposite side of the rear side portion 32, an concave assembly 36 in which a part of the end face is concaved in the Y direction. In the second divided core 3*b*, each of the assemble convex portion 35 and the concave assembly 36 is formed entirely in the second divided core 3*b* in the Z direction.

The first divided core 3*a* and the second divided core 3*b* are assembled such that the convex assembly 35 of the first divided core 3*a* is fitted into the concave assembly 36 of the second divided core 36, and the convex assembly 35 of the second divided core 3*b* is fitted into the assembled concave portion 36 of the first divided core 3*a*. In other words, each protrusion direction of the convex assembly 35 in the first and second divided cores 3*a* and 3*b* and a direction (i.e. X direction) along which the concave assembly 36 is concaved, correspond to a direction along which the first divided core 3*a* and the second divided core 3*b* are assembled. The first divided core 3*a* and the second divided core 3*b* are attached to the core cover 2.

As shown in FIG. 2, for the core cover 2, the pair of support portions 21 support the rear side portion 32 of the outer peripheral core 3 and the pair of side portions 331 and 332. The core cover 2 has a U-shape which is opened in the front side X1. In other words, the core cover 2 has a pair of side cover portions 23 and the rear cover portion 24. The pair of side cover portions 32 are formed in the X direction and arranged in parallel in the Y direction, when viewed from the Z direction. Further, the pair of side cover portions 23 supports the pair of side portions 331 and 332. The rear cover 24 couples rear edges of the side cover portions 23 in the Y direction and supports the rear side portion 32.

Figure 6:
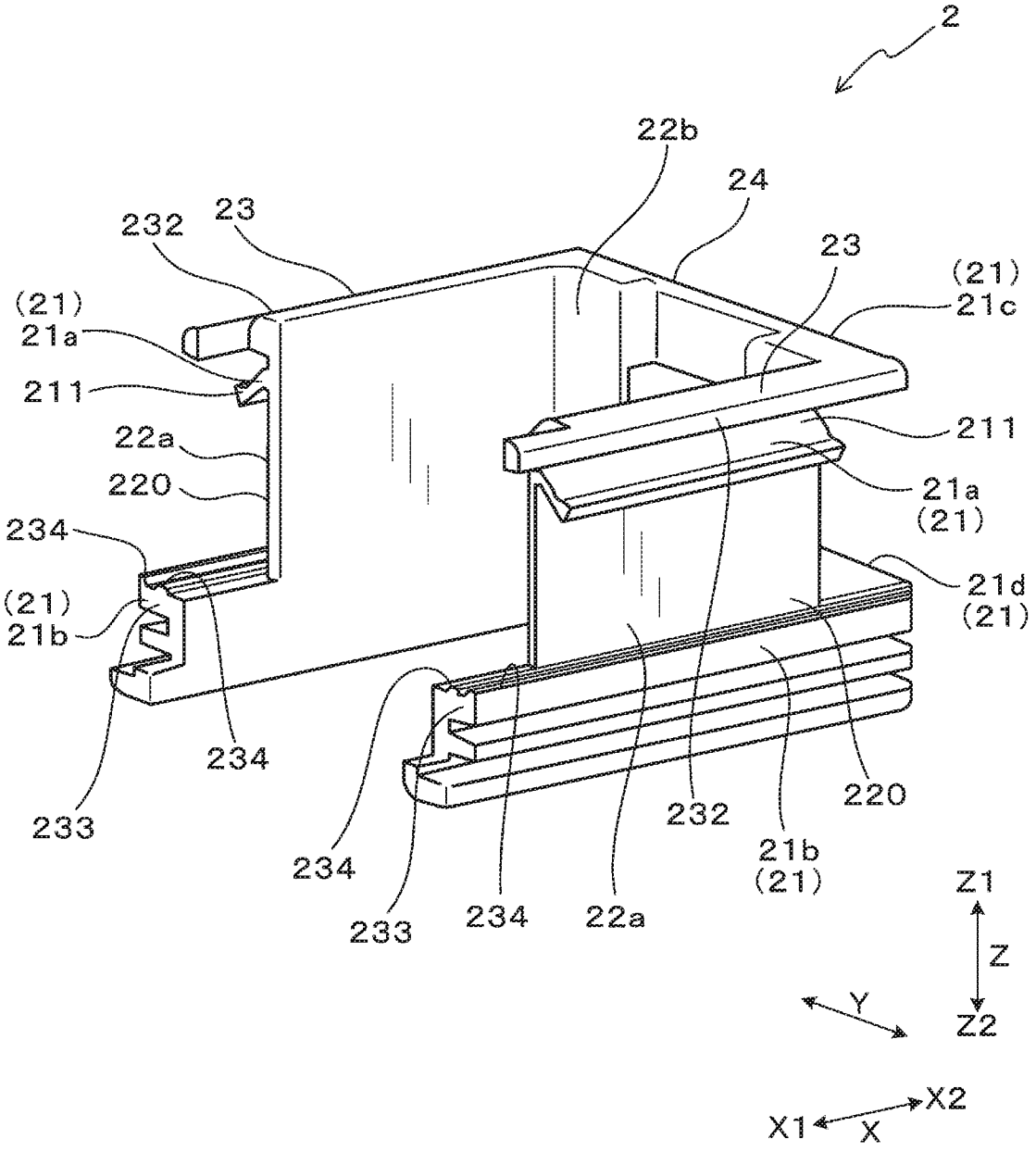
FIG. 6 is a diagram showing a perspective view of the core cover according to the first embodiment.

As shown in FIGS. 6 to 8, each of the rear cover portion 24 and the side cover portion 23 includes a pair of support portions 21 and a coupling portion 22*a*, 22*b*. The pair of support portions 21 are provided on both sides of the outer peripheral core 3 in the Z direction, and support the outer peripheral core 3. The coupling portions 22*a* and 22*b* are provided in the inner periphery side of the outer peripheral core 3, and couple the pair of support portions 21. The coupling portions 22*a*, 22*b* are formed in a plate shape to face the inner peripheral surface of the outer peripheral core 3. In other words, the coupling portion 22*a* and 22*b* includes a cover facing surface 220 that faces the outer peripheral core 3.

Hereinafter, among portions constituting the side cover portion 23 in the pair of support portions 21, a portion in the upper side Z1 is referred to as a first side support portion 21*a*, and a portion in the lower side Z2 is referred to as a second side support portion 21*b*. Moreover, a portion constituting the side cover portion 23 in the coupling portion 22*a*, 22*b* is referred to as a side coupling portion 22*a*. Further, among portions constituting the rear cover portion 24 in the pair of support portions 21, a portion in the upper side Z1 is referred to as a first rear support portion 21*c*, and a portion in the lower side Z2 is referred to as a second rear support portion 21*d*. A portion constituting the rear cover portion 24 in the coupling portion 22*a*, 22*b* is referred to as a rear coupling portion 22*b*.

Figure 5:
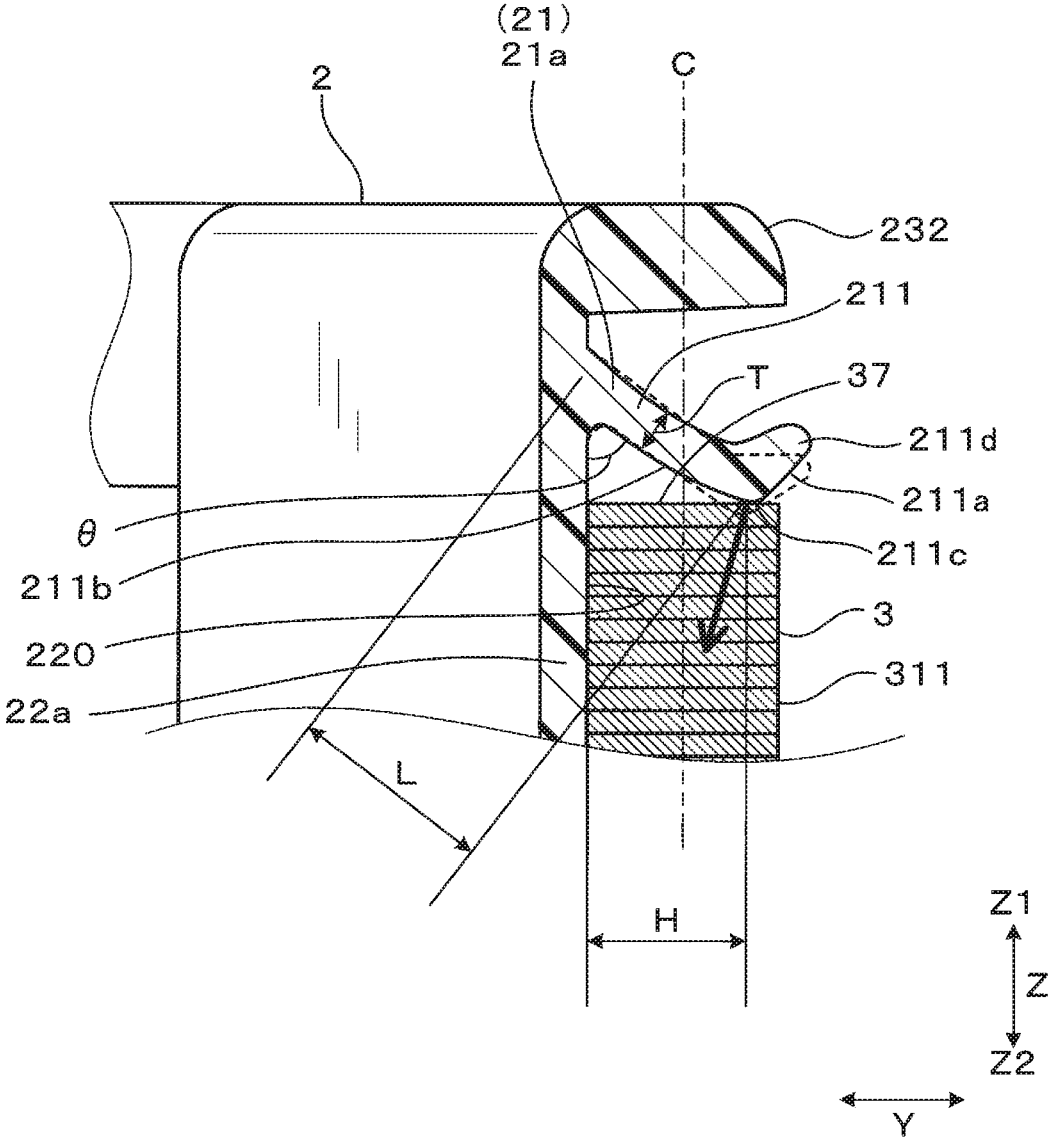
FIG. 5 is a diagram showing an enlarged view of a portion in the vicinity of the flexible portion shown in FIG. 4 according to the first embodiment.

The first side support portion 21*a* is provided with a flexible portion 211. As described, the flexible portion 211 has flexibility in the Z direction. The flexibility refers to a property of capable of being deformed in which an object is significantly bent in response to a force applied thereto. According to the present embodiment, the flexible portion 211 has a property (elastic property) in which state returns to an original state when a force is not applied. In FIG. 5, an outline of the flexible portion 211 in a state before being deformed (i.e. free state without being deformed) is shown with a dotted line.

As shown in FIG. 5, the flexible portion 211 is inclined towards an outer peripheral core 3 side (i.e. lower side Z2) in the Z direction as it approaches one side in the Y direction. Specifically, the flexible portion 211 is inclined towards the outer peripheral core 3 side (i.e. lower side Z2) in the Z direction as the position of the flexible portion 211 becomes away from the cover facing surface 220 in the Y direction. The flexible portion 211 extends straight along a direction being oblique relative to both of the Y direction and the Z direction from the side coupling portion 22*a*. In the cover 2, the flexible portion 211 is not connected to portions other than the side coupling portion 22*a* of the side cover portion 23 where this flexible portion 211 is formed.

The flexible portion 211 is provided to be connected to the side coupling portion 22*a* in a cantilevered state. Hence, the flexibility portion 211 is capable of being deformed in the Z direction in response to a force applied to a portion in the vicinity of the end portion located away from the side coupling portion 22*a*, and can be returned to a substantially the original state (free state) when the applied force disappears.

As shown in FIG. 5, a guide surface 211*a* is formed in an end portion of a portion protruding from the side coupling portion 22*a* in the flexible portion 211. The guide surface 211*a* is a tapered surface inclined towards a cover facing surface 220 side in the Y direction as it approaches the outer peripheral core 3 side (i.e. lower side Z2. As will be described later, in the case where the first divided core 3*a* and the second divided core 3*b* are assembled, the first divided core 3*a* or the second divided core 3*b* are pressed on to the guide surface 211*a*, whereby the flexible portion 211 can be bent towards the upper side Z1.

As shown in FIG. 5, an adjacent surface 211*b* adjacent to the cover facing surface 220 side is inclined towards the upper side Z1 as it approaches the cover facing surface 220 side. A portion between the adjacent surface 211*b* and the guide surface 211*a* is a flexible contact portion 211*c* that contacts with the outer peripheral core 3. The flexible contact portion 211*c* is formed to protrude towards the lower side Z2 and elastically presses the upper surface of the outer peripheral core 3 towards the lower side Z2.

As shown in FIG. 5, in the flexible portion 211, a protrusion 211*d* is provided at an end portion located protruding from the side coupling portion 22*a*. The protrusion 211*d* protrudes towards a portion away from the flexible contact portion 211*c* in a direction orthogonal to a direction along which the flexible portion 211 protrudes from the side coupling portion 22*a*. The protrusion 21*d* is provided to readily form the guide surface 211*a* extending up to a portion in the upper side Z1, and let the guide surface 211*a* readily contact with the first divided core 3*a* or the second divided core 3*b*.

In the case where the flexible portion 211 is not bent, as in the free state, the shortest length in the Z direction between the upper end position of the guide surface 211*a* and the second side support portion 21*b* is larger than the length of the side portions 331 and 332 in the Z direction. Moreover, in the case where the flexible portion 211 is not bent as a free state, the shortest length in the Z direction between the lower end position of the guide surface 211*a* (i.e. position of the flexible contact portion 211*c*) and the second side support portion 21*b* is larger than the length of the side portions 331 and 332 in the Z direction. Thus, in the case where the outer peripheral core 3 is attached to the core cover 2 while the lower surface of the outer peripheral core 3 is being slide on the upper surface of the second side support portion 21*b*, the outer peripheral core 3 comes into contact with the guide surface 211*a*.

As shown in FIG. 5, a surface portion in the outer peripheral core 3 contacting with the flexible contact portion 211*c* is defined as a contact surface portion 37. In other words, the contact surface portion 37 is upper surfaces of respective side portions 331 and 332. The contact position between the contact surface portion 37 and the flexible contact portion 211*c* is positioned at a portion farther than the central position c of the contact surface portion 37 with respect to the cover facing surface 220 in a normal line direction (i.e. Y direction) of the cover facing surface 220. According to the present embodiment, the contact position between the contact surface portion 37 and the flexible contact portion 211*c* (i.e. position of the flexible contact portion 211*c*) is positioned at an end portion of the contact surface portion 37 which is furthest the cover facing surface 220 of the side coupling portion 22*a* in the Y direction.

As shown in FIG. 5, the core cover 2 including the flexible portion 211 is entirely made of, for example, polypropylene resin (PP). For the flexible portion 211, the thickness T can be larger than or equal to 0.8 mm. Thus, a strength and a formability of the flexible portion 211 can readily be secured. The thickness T of the flexible portion 211 can be smaller than or equal to 2 mm. Thus, the flexibility of the flexible portion 211 can readily be secured. Here, according to the present embodiment, since the flexible portion 211 has the protrusion 211*d*, the thickness of the tip end portion of the flexible portion 211 differs from that of other portions, where the thickness T refers to a thickness of a major portion of the flexible portion 211, unlike the thickness of the protrusion 211*d* having different thickness comparted to other portions of the flexible portion 211.

As shown in FIG. 5, for the flexible portion 211, the length L protruded from the side coupling portion 22*a* can be, for example, 3 mm. The protruded length L is defined as a length from the flexible contact portion 211*c* to a boundary portion between the flexible portion 211 and the side coupling portion 22*a*, with respect to a direction in which the flexible portion 211 protrudes from the side coupling portion 22. The length H from the flexible contact portion 211*c* to the side coupling portion 22*a* with respect to the Y direction may be set to be 0.8 mm for example. Further, the thickness T of the flexible portion 211 may preferably be smaller than or equal to ⅓ of the protruded length L in the point view of securing flexibility.

Also, as shown in FIG. 5, an angle formed between the flexible portion 211 and the cover facing surface 220 of the side coupling portion 22*a* may preferably satisfy a relationship of $0°<\theta<55°$. This numerical range is derived from a formula of a cantilevered beam. Thus, the flexible portion is not significantly protruded outwardly with respect to the Y direction and entire molding of the core cover 2 can readily be made. Note that θ is 35° according to the present embodiment.

As shown in FIGS. 3 to 6, the first side support portion 21*a* includes a side top plate portion 232 positioned in the upper side Z1 of the flexible portion 211, facing the upper surfaces of the side portions 331 and 332 of the outer peripheral core 3. The side top plate portion 232 is formed in a plate-like shape having a thickness in the Z direction and a longitudinal side in the X direction. The side top plate portion 232 is formed to cover the flexible portion 211 from the upper side Z1.

Figure 3:
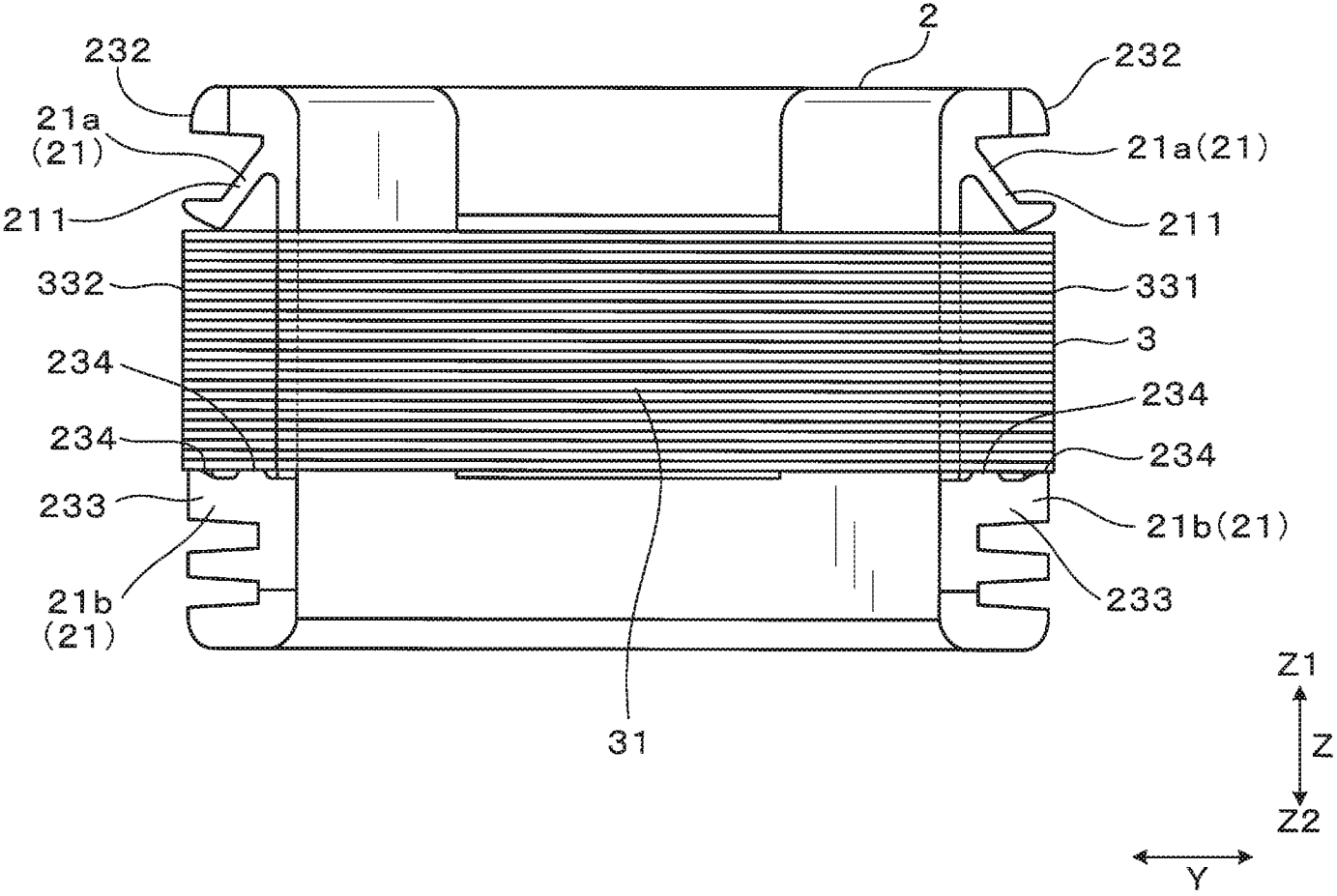
FIG. 3 is a diagram showing a front view of the core cover and the outer peripheral core when viewed from a front side, according to the first embodiment.
Figure 4:
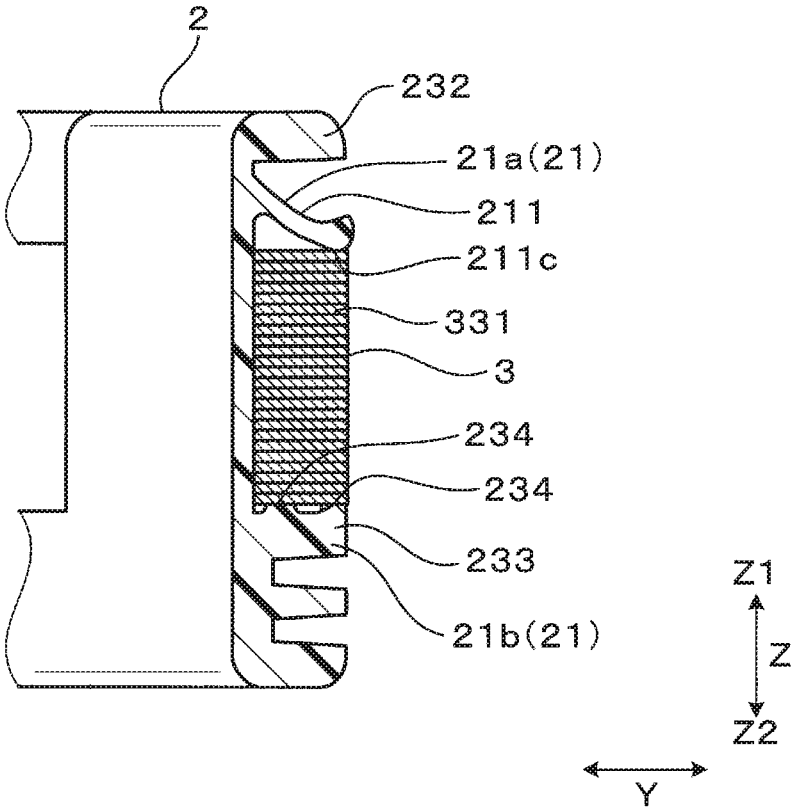
FIG. 4 is a diagram showing a cross-sectional view of the core cover and the outer peripheral core which passes through a flexible portion.

As shown in FIGS. 3, 4 and 6, the second side support portion 21*b* includes a side bottom plate portion 233 formed in the X direction on the lower surface of the side portions 331 and 332 of the outer peripheral core 3, and a side rib 234 protruding towards the upper side Z1 from the side bottom portion 233.

As shown in FIG. 4, the side rib 234 is being contact with the lower surface of the side portions 331 and 332 of the outer peripheral core 3, and supports the side portion 331 and 332 between the flexible portion 211 and the side rib 234 in the Z direction. The side rib 234 is formed in convex (convex stripe) to have a longitudinal side in the X direction on the upper surface of the side bottom portion 233. The side rib 234 is formed at each of the two portions in the Y direction on the respective side bottom portions 233. As shown in FIG. 6, the side ribs 234 formed in the respective side bottom plate portions 233 are in parallel each other. Each side rib 234 is entirely formed on the upper surface of the bottom plate portion with respect to the X direction.

As shown in FIGS. 7 and 8, the first rear support portion 21*c* includes a rear top plate portion 242 formed on the upper surface of the rear side portion 32 of the outer peripheral core 3 with respect to the Y direction, and a rear first rib 243 protruding towards the lower side Z2 from the rear top plate portion 242.

The rear top plate portion 242 is formed in the Y direction to connect the rear ends of a pair of side top plate portions 232. A raised portion 244 is formed at a center portion except both end portion of the rear top plate portion 242 with respect to the Y direction. The raised portion 244 bulges protruding towards the lower side Z2 with respect to the both ends thereof. Further, a first rib 243 is formed protruding towards the lower side Z2 from the lower surface of the raised portion 244.

As shown in FIG. 7, the first rear rib 243 contacts with the upper surface of the rear side portion 32 of the outer peripheral core 3. The first rear rib 243 is formed convex (as a convex stripe) to have a longitudinal side in the X direction on the lower surface of the raised portion 244. As shown in FIG. 8, the first rear rib 243 is formed at each of two portions of the raised portion 244 in the Y direction.

The second rear support portion 21*d* includes a rear bottom plate portion 245 formed on the lower surface of the rear side portion 32 of the outer peripheral core 3 with respect to the Y direction, and a rear second rib 246 protruding towards the upper side Z1 from the rear bottom plate portion 245.

The rear bottom plate portion 245 is formed in the Y direction to connect the rear ends of a pair of side bottom plate portions 233. The rear bottom plate portion 245 is formed facing the lower surface of the rear side portion 32 of the outer peripheral core 3. Further, a second rib 246 is formed protruding towards the upper side Z1 from the upper surface of the rear bottom plate portion 245.

The second rear rib 246 contacts with the lower surface of the rear side portion 32 of the outer peripheral core 3. The second rear rib 246 is formed in convex (convex stripe) to have a longitudinal side in the X direction on the upper surface of the rear bottom plate portion 245. The second rear rib 246 is formed at two portions of the rear bottom plate portion 245 in the Y direction. The second rear rib 246 is forms at a portion overlapping with the first rear rib 243 in the Z direction. Further, a rear side portion 32 of the outer peripheral core 3 is supported between the first rear rib 243 and the second rear rib 246.

As shown in FIGS. 2 and 8, the rear coupling portion 22*b* includes, at a center portion, a through hole 241*a* penetrating therethrough in the X direction. A part of the inner peripheral surface of the rear side portion 32 is an exposed surface being exposed towards the inner periphery side from the through hole 241*a*. As shown in FIGS. 1 and 9, a center core 4 is provided in an inner periphery side of the outer peripheral core 3.

The center core 4 together with the outer peripheral core 4 forms a closed magnetic circuit. Similar to the outer peripheral core 3, the core 4 is composed of coated steel plates laminated in the Z direction, each coated steel plate having a thickness in the Z direction. As shown in FIG. 9, the center core 4 is provided with a column portion 41 formed in the X direction having a rectangular column shape, and a flange portion 42 protruding from the front end portion of the column portion 41 towards both sides thereof in the Y direction. The center core 4 has a T-shape as a whole. The center core 4 includes a flange portion in the front side X1, thereby increasing a cross-sectional area orthogonal to the X direction in the front side X1 of the center core 4.

The center core 4 is provided such that the rear surface of the column portion 41 faces, in the X direction, the inner peripheral surface of the rear side portion 32 of the outer peripheral core 3 exposed from the through hole 241*a* of the core cover 2. As shown in FIGS. 1 and 9, a magnetic body 18 is disposed between the front surface of the center core 4 and the front side portion 31 of the outer peripheral core 3. The magnetic body 18 is used to improve the output voltage of the ignition coil 1. Specifically, the magnetic body applies a magnetic bias to the center core 4 to increase an amount of change of the magnetic flux when the energization of the primary coil 11 is cutoff, thereby enhancing the induced voltage of the secondary coil 12. As shown in FIG. 1, the center core 4 is embedded inside a primary spool 14.

The first spool 14 is formed by an insert molding in which the center core 4 is provided inside the molding. The primary spool 14 is made of resin or the like which is electrically insulating. The primary spool 14 is formed integrally with a later-described connector portion 15.

The primary coil 11 is wound around the outer periphery side of the column portion 41 of the center core 4 in the primary spool 14. The primary coil 11 is wound around an axis extended in the X direction. The secondary coil 12 is provided co-axially with the primary coil 11 in the outer periphery side of the primary coil 11.

The secondary coil 12 is wound around the outer periphery portion of the secondary spool 16 provided in the outer periphery side of the primary coil 11. The secondary spool 16 is formed such that material having an electrical insulation property is formed in a cylindrical shape. The secondary spool 16 includes the secondary coil 11 being inserted inside thereof.

As shown in FIG. 1, an ignitor 13 is provided in the front side X1 of the front side portion 31 of the outer peripheral core 3. The ignitor 13 is configured to energize the primary coil 11 and cutoff the energized primary coil 11. The components constituting the ignition coil 1 are accommodated in the case 5.

The case 5 is provided with a case body 51 accommodating the components of the ignition coil 1. The case body 51 is formed in a box shape of which the upper end is opened. A connector portion 15 integrated with the first spool 14 is engaged with a wall portion of the front side X1 of the case body 51. The connector portion 15 connects the ignition coil 1 with a wire harness or the like connected to external equipment. The case 5 includes the high voltage tower portion 52 having a cylindrical shape protruding towards the lower side Z2 from the case body 51.

When viewing the case 5 only, the internal space of the high voltage tower portion 52 communicates with the internal space of the case body 51. In the ignition coil 1, a high voltage output terminal 17 made of metal is fitted into the high voltage tower portion 52. Thus, an end portion of the high voltage tower 52 in a case body 51 side is closed. The high voltage terminal 17 prevent a sealing resin 6 in the case 5 from being leaked towards the high voltage tower portion 5 side from the case body portion 51, and serves as an output terminal of the ignition coil 1. The sealing resin is filled in the case body 51.

The sealing resin is made of, for example, an epoxy resin. The sealing resin 6 seals components constituting the ignition coil 1 provided in the case body 51.

The core cover 2 is constituted by material capable of being peeled off from the sealing resin 6. Thus, a thermal stress can be prevented from being generated between the core cover 2 and the sealing resin 6. As a result, thermal stress can be prevented from being generated between the outer peripheral core 3 and the sealing resin 6. In other words, the core cover 2 is disposed between the outer peripheral core 3 and the sealing resin 6 so as to mitigate the thermal stress therebetween. According to the present embodiment, the sealing resin is made of epoxy resin and the core cover 2 is made of polypropylene.

Next, an example of assembling the outer peripheral core 3 to the core cover 2 will be described.

Figure 10:
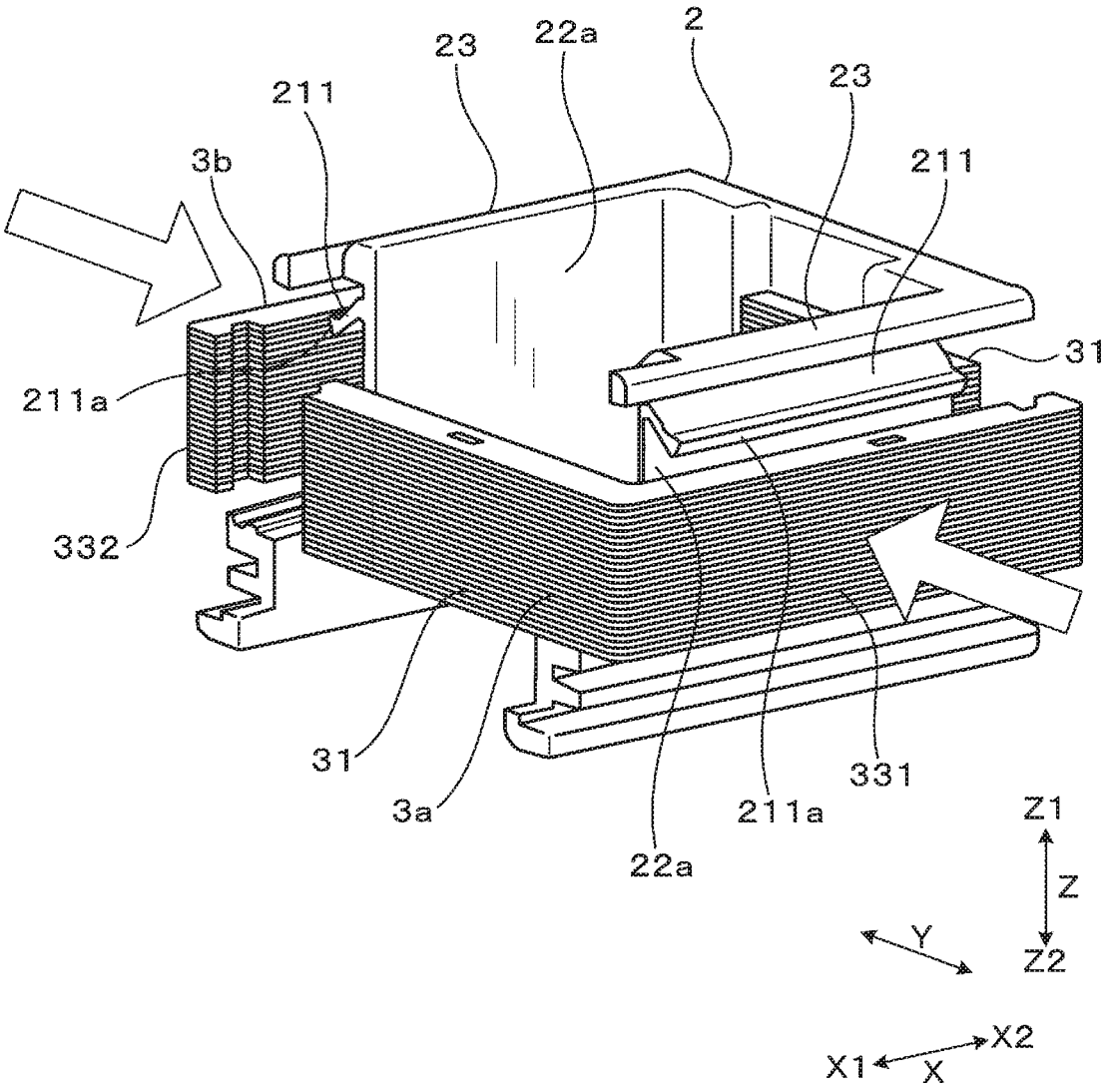
FIG. 10 is a diagram showing a disassembled perspective view of the core cover, a first divided core, and a second divided core according to the first embodiment.
Figure 11:
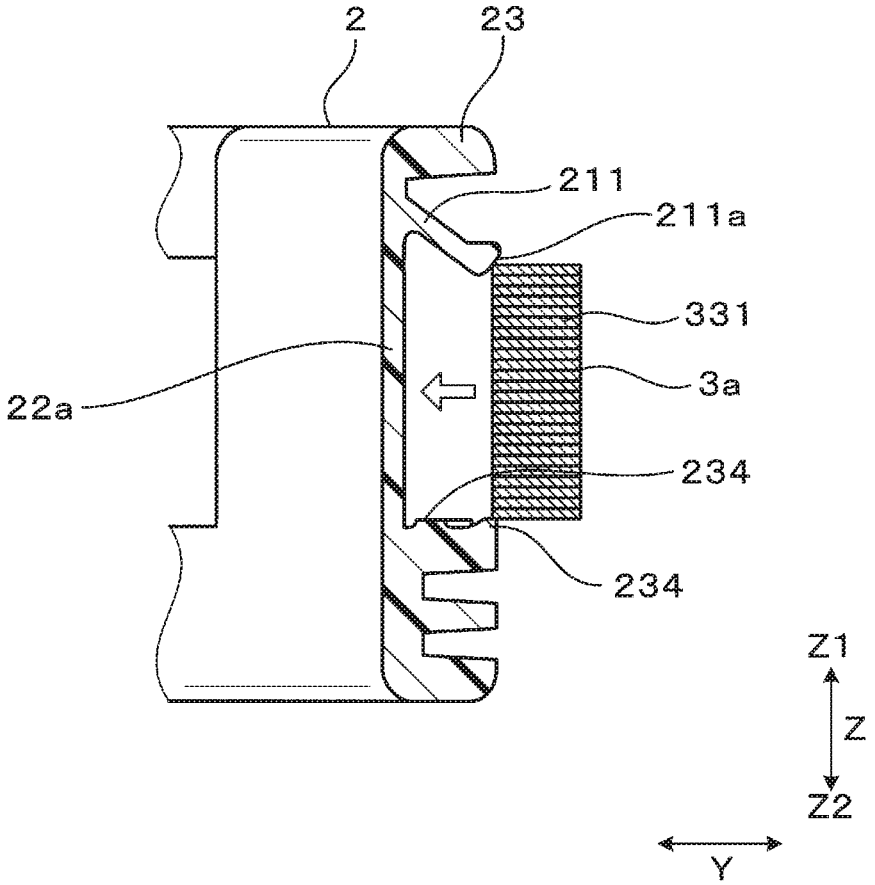
FIG. 11 is a diagram showing a cross-sectional view of the core cover and a side portion which passes through the flexible portion, and a state in which the side portion contacts with a guide surface of the flexible portion, according to the first embodiment.

As shown in FIGS. 10 and 11, the first divided core 3*a* is attached to one side cover portion 23 of the core cover 2. In other words, as shown in FIG. 11, the side portion 331 of the first divide core 2*a* is inserted in the Y direction between the side rib 234 of the side cover portion 23 and the flexible portion 211. At this moment, the lower surface of the side portion 331 slide on the upper surface of the side rib 234, and making a corner portion of the upper portion of the side portion 331 come into contact with the guide surface 211*a* of the flexible portion 211.

Figure 12:
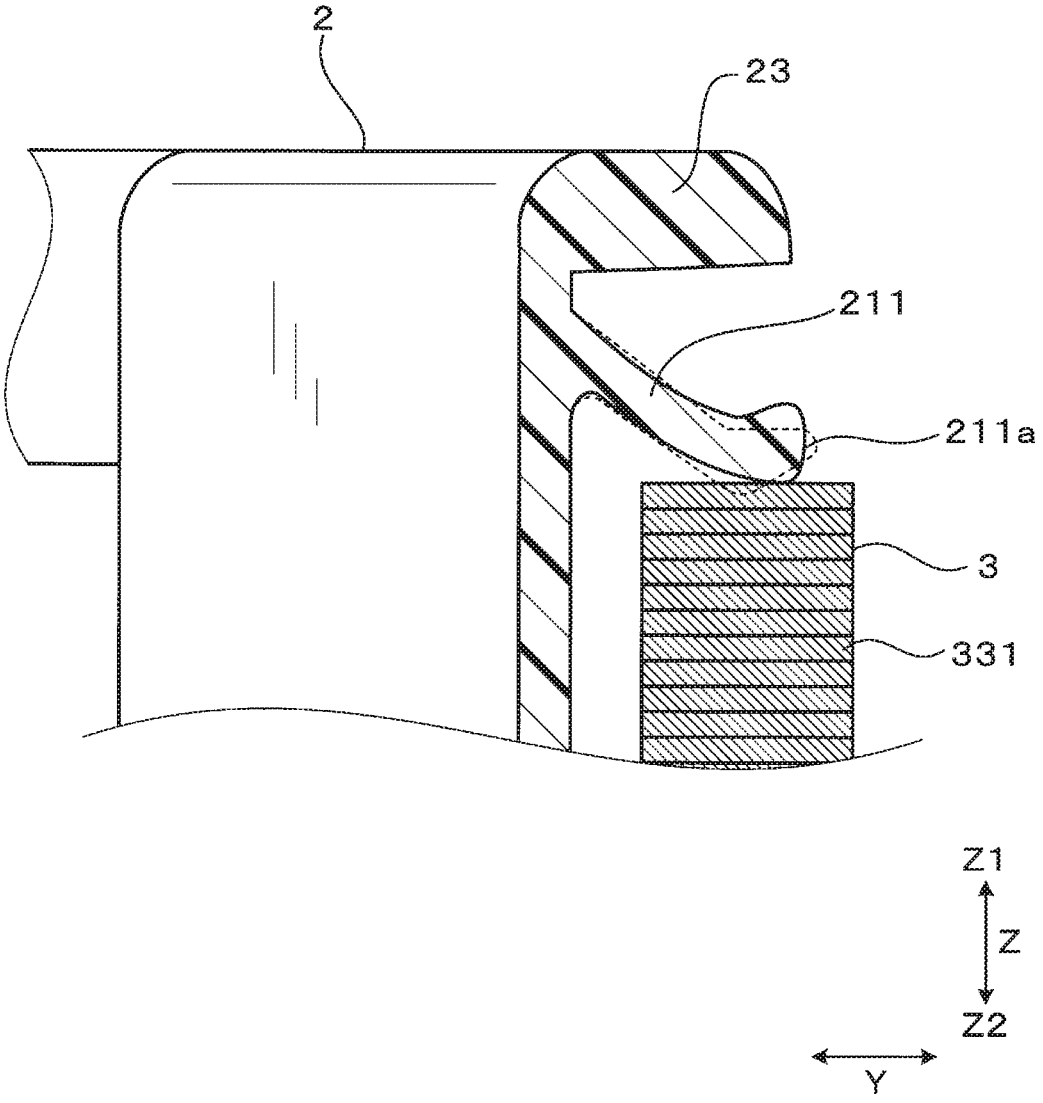
FIG. 12 is a diagram showing a cross-sectional view of the core cover and a side portion which passes through the flexible portion, and a state in which the flexible portion is bent by being pressed by the side portion according to the first embodiment.

In this state, the first divided core 3*a* is further put towards the side coupling portion 22*a* in the Y direction. Thus, as shown in FIG. 12, the guide surface 211*a* slides on the corner portion of the side portion 331 and is elastically deformed towards the upper side Z1. Thus, an interval between the flexible portion 211 and the side rib 234 is expanded in the Z direction, and the outer peripheral core 3 is inserted between the flexible portion 211 and the side rib 234. Then, the elastic force of the flexible portion 211 (i.e. restoring force returning the flexible portion 211 to the free state, which is shown with an arrow in FIG. 5), influences the outer peripheral core 3.

For the first divided core 3*a*, the side portions 331 and 332 are inserted between the pair of support portions 21 and being supported therebetween, until the inner peripheral surfaces of the side portions 331 and 332 come into contact with the cover facing surface 220. Also, the first divided core 3*a* is assembled such that the concave assembly 36 is assembled to be protruded in the rear side X2 with respect to the side coupling portion 22*a* of the side cover portion 23.

For assembling the second divided core 3*b* with the core cover 2, the second divided core 3*b* is inserted in the Y direction between the flexible portion 211 of the side cover portion 23 which does not support the first divided core 3*a* and the side rib 234. At this moment, the lower surfaces of the side portions 331 and 332 slide on the upper surface of the side rib 234, making corner portions of the upper portions of the side portions 331, 332 come into contact with the guide surface 211*a* of the flexible portion 211.

In this state, the second divided core 3*b* is further urged towards the side coupling portion 22*a* in the Y direction to have the flexible portion 211 deformed similar to the first divided core 3*a*, whereby the side portion 332 of the second divided core 3*b* is supported between the flexible portion 211 of the side cover portion 23 and the side rib 234.

Further, the rear side portion 32 of the second divided core 3*b* is inserted in the X direction between the pair of support portions 21. In other words, the rear side portion 32 is inserted between the first rear rib 243 and the second rear rib 246. Here, in a state before the core is attached to the rear cover portion 24, the length between the first rear rib 243 and the second rear rib 246 in the Z direction is slightly smaller than that of the rear side portion 32 in the Z direction. The rear side portion 32 is press-fitted between the first rear rib 243 and the second rear rib 246.

Also, the convex assembly 35 of the second divided core 3*b* is inserted into the concave assembly 36 of the first divided core 3*a* attached to the core cover 2, and the concave assembly 36 of the second divided core 3*b* is engaged with the convex assembly 35 of the first divided core 36.

A process for inserting the side portion 332 of the second divided core 3*b* between the flexible portion 211 of the side cover portion 23 and the side rib 234, a process for inserting the rear side portion 32 between the first rear rib 243 of the rear cover portion 24 and the second rear rib 246, and a process for engaging the convex assembly 35 and the concave assembly 36 of the second divided core 3*b* with the concave assembly 36 and the convex assembly 35 of the first divided core 3*a* can be simultaneously performed with a process for assembling the second divided core 3*b* with the core cover 2. Thus, the outer peripheral core 3 is attached to the core cover 2.

Next, effects and advantages of the present embodiment will be described. In the ignition coil 1 of the present disclosure, at least one of the pair of support portions 21 include a flexible portion 211 that elastically presses the outer peripheral core 3, the flexible portion 211 having a flexibility in a direction along which the pair of support portions 21 is arranged. Hence, when assembling the core cover 2 and the outer peripheral core 3, the flexible portion 211 is bent in the Z direction, whereby the interval between the pair of support portions 21 can be changed. Hence, the outer peripheral core 3 can be reliably arranged between the pair of support portions 21.

The outer peripheral core 3 is composed of coated steel plates laminated in the Z direction. Hence, the manufacturing tolerance of size of the outer peripheral core 3 in the Z direction is likely to be larger. Hence, assuming the core cover 2 does not have the flexible portion 211, it is possible that the outer peripheral core 3 cannot be attached to the core cover 2 or the outer peripheral core 3 is difficult to be attached to the core cover 2. However, as described above, according to the present embodiment, since the interval between the pair of support portions 21 can be changed by bending the flexible portion 211 in the Z direction, the outer peripheral core 3 can readily be attached to the core cover 2 even in a case where a large manufacturing tolerance in the Z direction is present in the outer peripheral core 3.

The flexible portion 211 includes a guide surface 211*a* inclined towards the cover facing surface 220 side as it approaches the outer peripheral core 3 side. Hence, when the outer peripheral core 3 is attached to the core cover 2, the outer peripheral core 3 comes into contact with the guide surface 211*a* of the flexible portion 211, pressing the guide surface 211*a*, whereby the flexible portion can be bent. Therefore, the outer peripheral core 3 can be attached to the core cover 2 more easily.

The contact position between the contact surface portion 37 and the flexible portion 211 is located at a portion farther than the center portion c with respect to the cover facing surface 220 in the normal line direction (i.e. Y direction) of the cover facing surface 220. Hence, the force (shown in FIG. 5 with an arrow) applied to the outer peripheral core 3 from the flexible portion 211 is likely to include a component applied towards the coupling portions 22*a* and 22*b* side (i.e. inside portion with respect to the Y direction). As a result, the flexible portion 211 is able to press (support) the outer peripheral core 3 towards the side coupling portion 22*a* side, and the outer peripheral core 3 can be prevented from detaching from the pair of support portions 21.

The flexible portion 211 is inclined towards the outer peripheral core 3 side (i.e. lower side Z2) as it approaches one side in the Y direction orthogonal to the Z direction. Hence, sufficient length of the flexible portion is likely to be secured so that the flexible portion 211 can readily be bent.

As described, according to the present embodiment, an ignition coil capable of improving an assembling ability of the outer peripheral core with the core cover can be provided.

Second Embodiment

Figure 13:
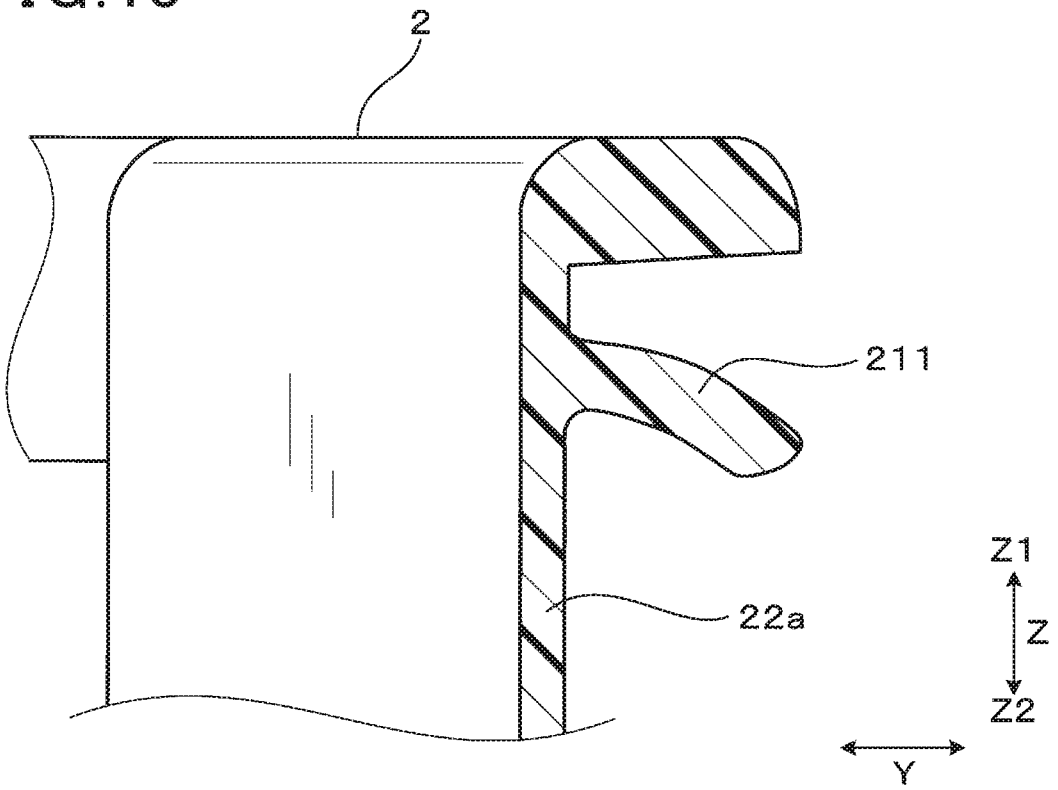
FIG. 13 is a diagram showing a cross-sectional view of a core cover which passes through a flexible portion according to a second embodiment.

As shown in FIG. 13, according to the second embodiment, the shape of the flexible portion 211 is modified from the first embodiment.

According to the present embodiment, the flexible portion 211 is formed into a curved shape from the root portion (i.e. boundary portion with respect to the side coupling portion 22*a*) to the tip end portion (i.e. end portion in a protruded side from the side coupling portion 22*a*). Note that a part of the flexible portion 211 may not be formed into a curved shape as long as the portion from the root portion to the tip end portion is formed into a curved shape. The flexible portion 211 is curved towards the lower side Z2 as it goes farther from the side coupling portion 22*a*. In other words, the flexible portion 211 is formed into a curved shape so as to slightly expand obliquely towards the upper side, crossing both of the Y direction and the Z direction.

Other configurations are same as those in the first embodiment. Reference numbers same as those in the existing embodiments among those used in the second embodiments and latter embodiments indicate the same constituents as those in the existing embodiments unless otherwise specified.

According to the present embodiment, the flexible portion 211 has a curved shape from the root portion to the tip end portion. Hence, sufficient length of the flexible portion is likely to be secured so that the flexible portion 211 can readily be bent. Besides according to the present embodiment, the same effects and advantages as those in the first embodiment can be obtained.

Third Embodiment

Figure 14:
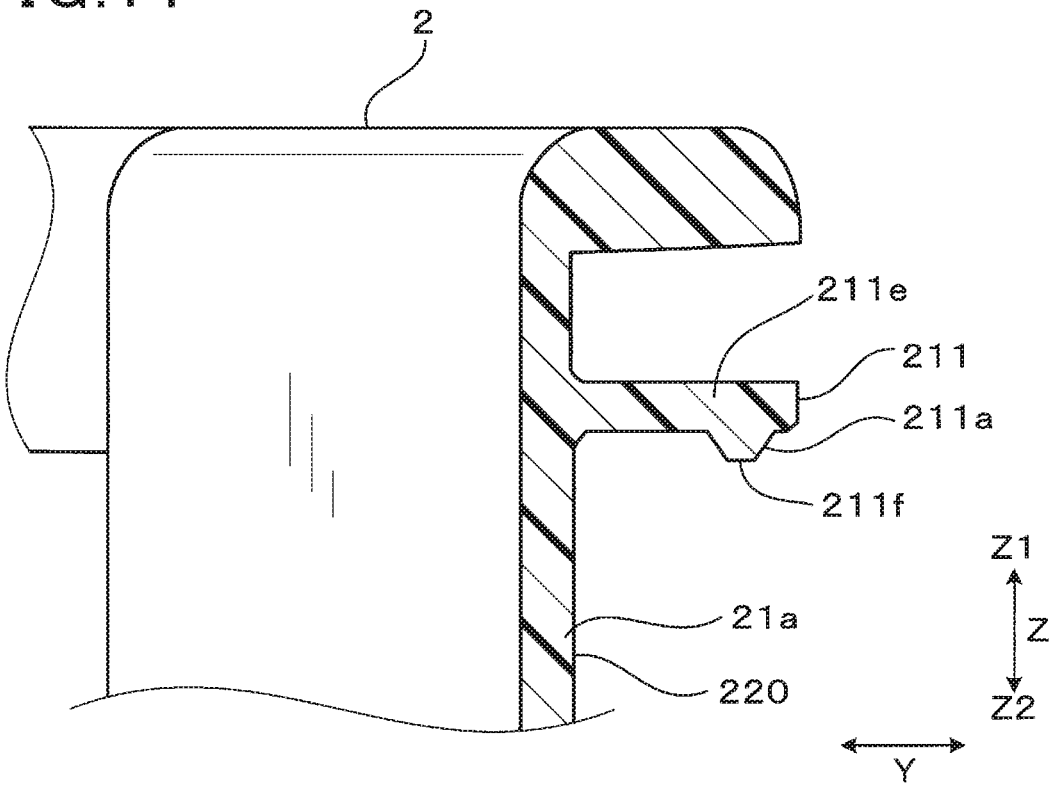
FIG. 14 is a diagram showing a cross-sectional view of a core cover which passes through a flexible portion according to a third embodiment.

As shown in FIG. 14, according to the third embodiment, the shape of the flexible portion 211 is modified from the first embodiment.

According to the present embodiment, the flexible portion 211 includes a flexible body portion 211*e* formed extending from the side coupling portion 22*a* along a normal direction (Y direction) of the cover facing surface 220 of the side coupling portion 22*a*, and a flexible protrusion 211*f* protruding towards the lower side Z2 at an end portion positioned in far side with respect to the side coupling portion 22*a* in the flexible body portion 211*e*.

The flexible protrusion 211*f* is provided such that both surfaces in the Y direction are formed into a taper shape becoming narrower in the Y direction towards the tip end side. A surface of the flexible protrusion 211*f* positioned in the far side from the side coupling portion 22*a* in the Y direction constitutes the above-described guide surface 211*a*. Other configurations are same as those in the first embodiment.

Besides according to the present embodiment, the same effects and advantages as those in the first embodiment can be obtained.

Fourth Embodiment

Figure 15:
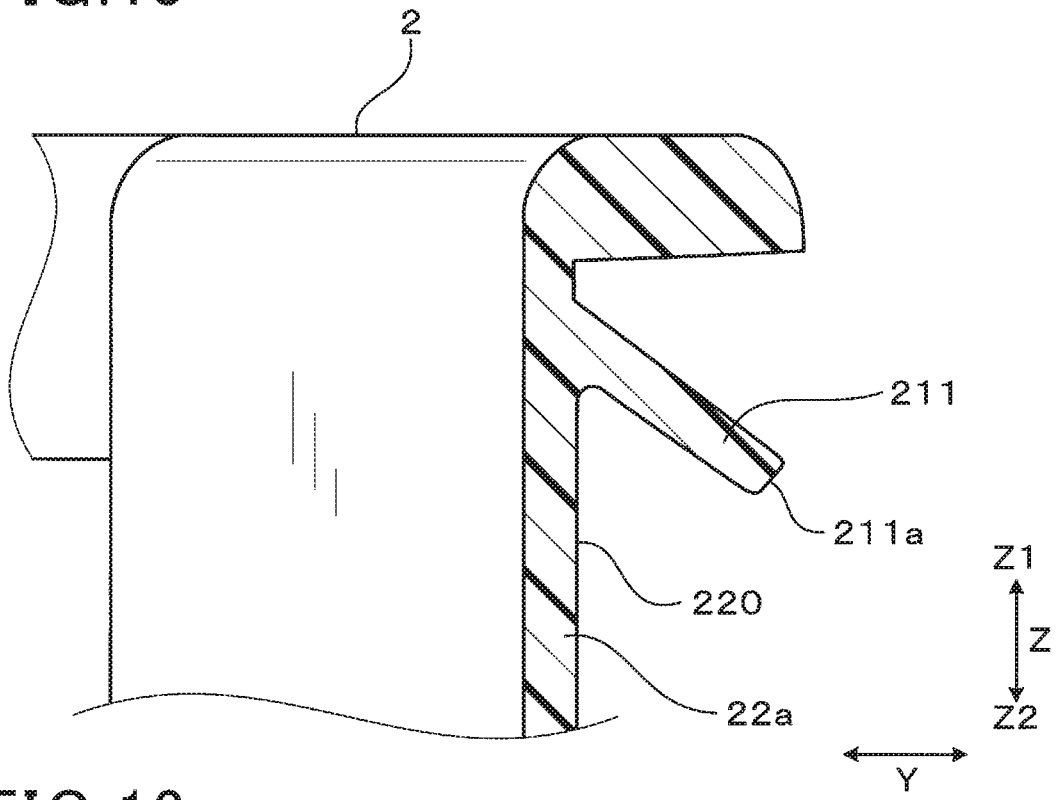
FIG. 15 is a diagram showing a cross-sectional view of a core cover which passes through a flexible portion according to a fourth embodiment.

As shown in FIG. 15, according to the fourth embodiment, the shape of the flexible portion 211 is changed from the first embodiment.

Similar to the first embodiment, the flexible portion 211 is formed to be inclined towards far side with respect to the cover facing surface 220 as it goes towards the outer peripheral core 3 side in the Z direction (i.e. lower side Z2). In other words, the flexible portion 211 is extended straight an oblique direction which is inclined with respect to both of the Y direction and the Z direction. Then, the flexible portion 211 according to the present embodiment has a constant thickness in the oblique direction. In other words, the flexible portion 211 is entirely formed in a plate-shape, and the protrusion described in the first embodiment (211*d* shown in FIG. 5) is not formed in the present embodiment. Other configurations are same as those in the first embodiment.

Besides according to the present embodiment, the same effects and advantages as those in the first embodiment can be obtained.

Fifth Embodiment

Figure 16:
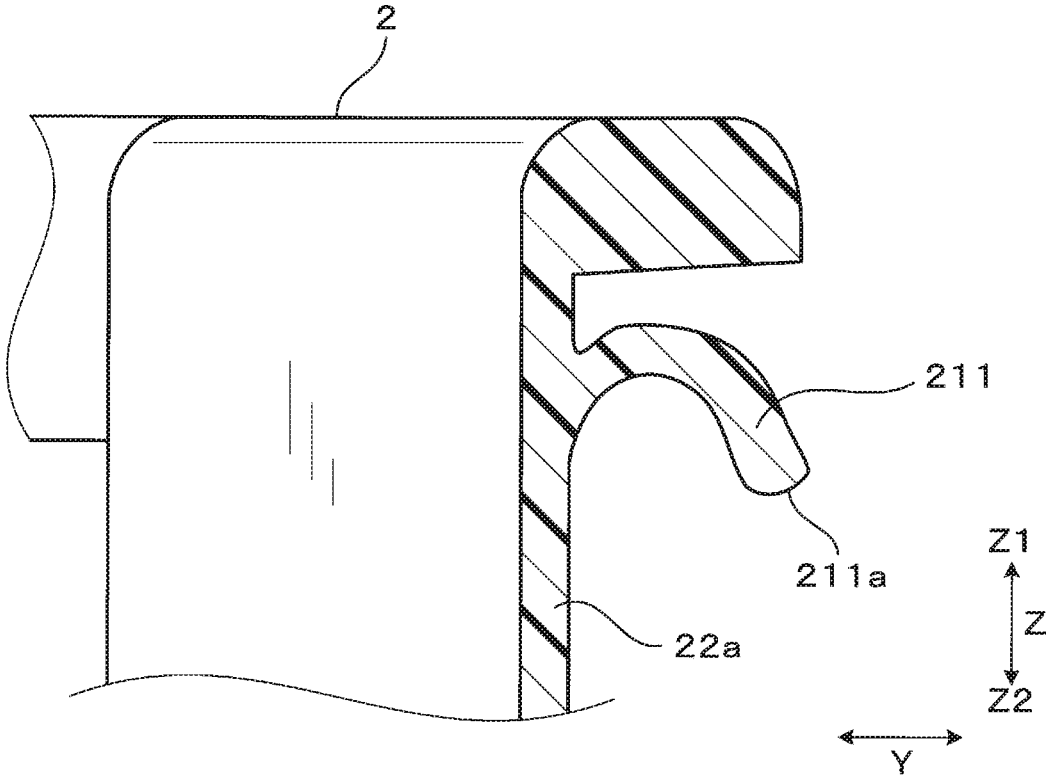
FIG. 16 is a diagram showing a cross-sectional view of a core cover which passes through a flexible portion according to a fifth embodiment.

As shown in FIG. 16, according to the fifth embodiment, the shape of the flexible portion 211 is changed from the first embodiment.

According to the present embodiment, the flexible portion 211 is formed into a curved shape from the root portion (i.e. boundary portion with respect to the side coupling portion 22*a*) to the tip end portion (i.e. end portion in a protruded side from the side coupling portion 22*a*). The flexible portion 211 is formed in an arc shape in which the center portion in the Y direction expands towards the upper side Z1. In the flexible portion 211, an end portion located in an opposite side with respect to the side coupling portion 22*a* is formed in an arc shape, and at least part of the end portion forms a guide surface 211*a*. Other configurations are same as those in the first embodiment.

The flexible portion 211 has a curved shape from the root portion to the tip end portion. Hence, a length of an arm from the root portion to the tip end portion can be longer. Thus, in the case where the outer peripheral core 3 is attached to the core cover 2, an amount of deformation per unit length of the flexible portion 211 becomes smaller, thus reducing the stress of the flexible portion 211. Other configurations are same as those in the first and second embodiments.

Sixth Embodiment

Figure 17:
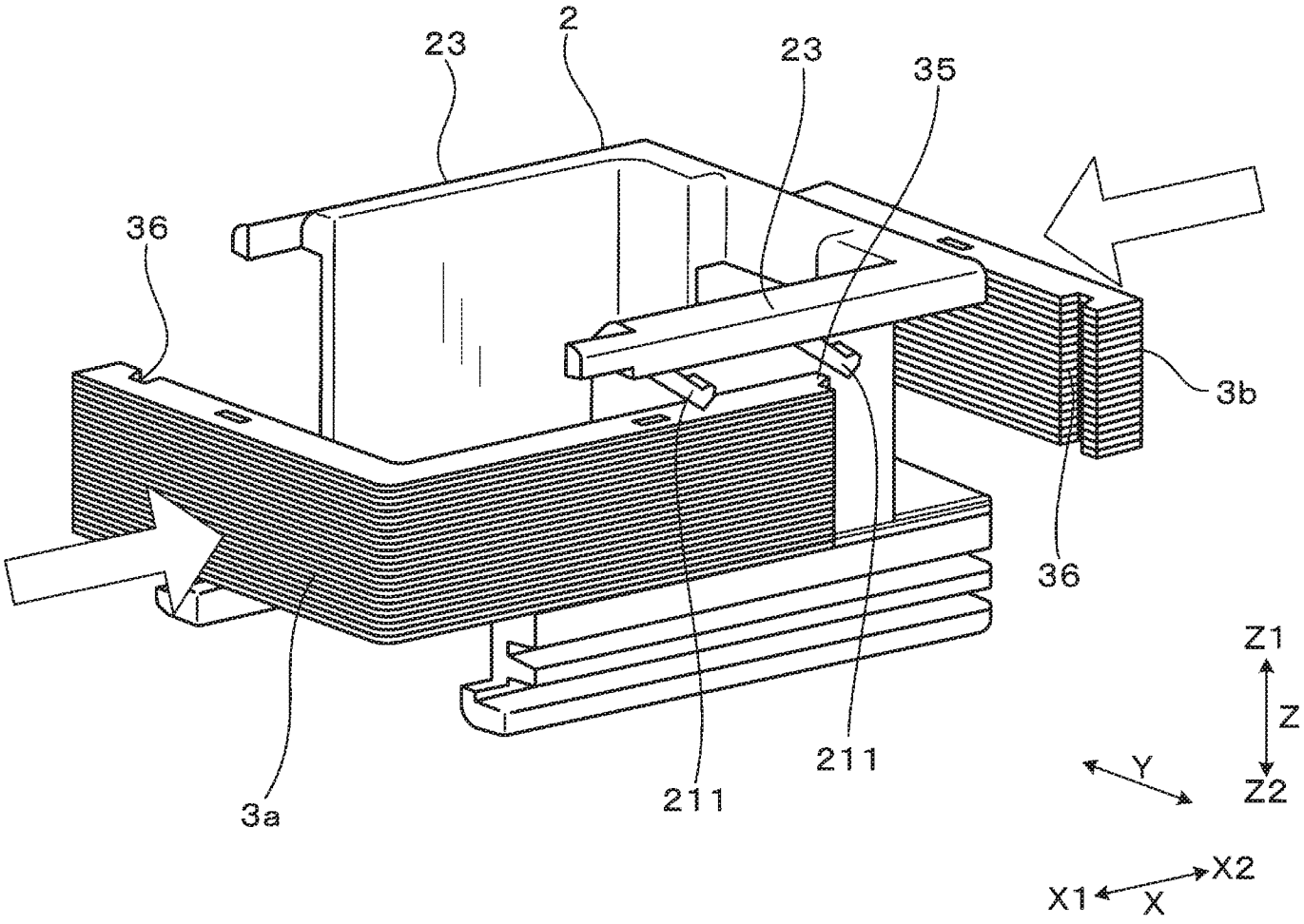
FIG. 17 is a diagram showing a disassembled perspective view of the core cover, a first divided core, and a second divided core according to a sixth embodiment.
Figure 18:
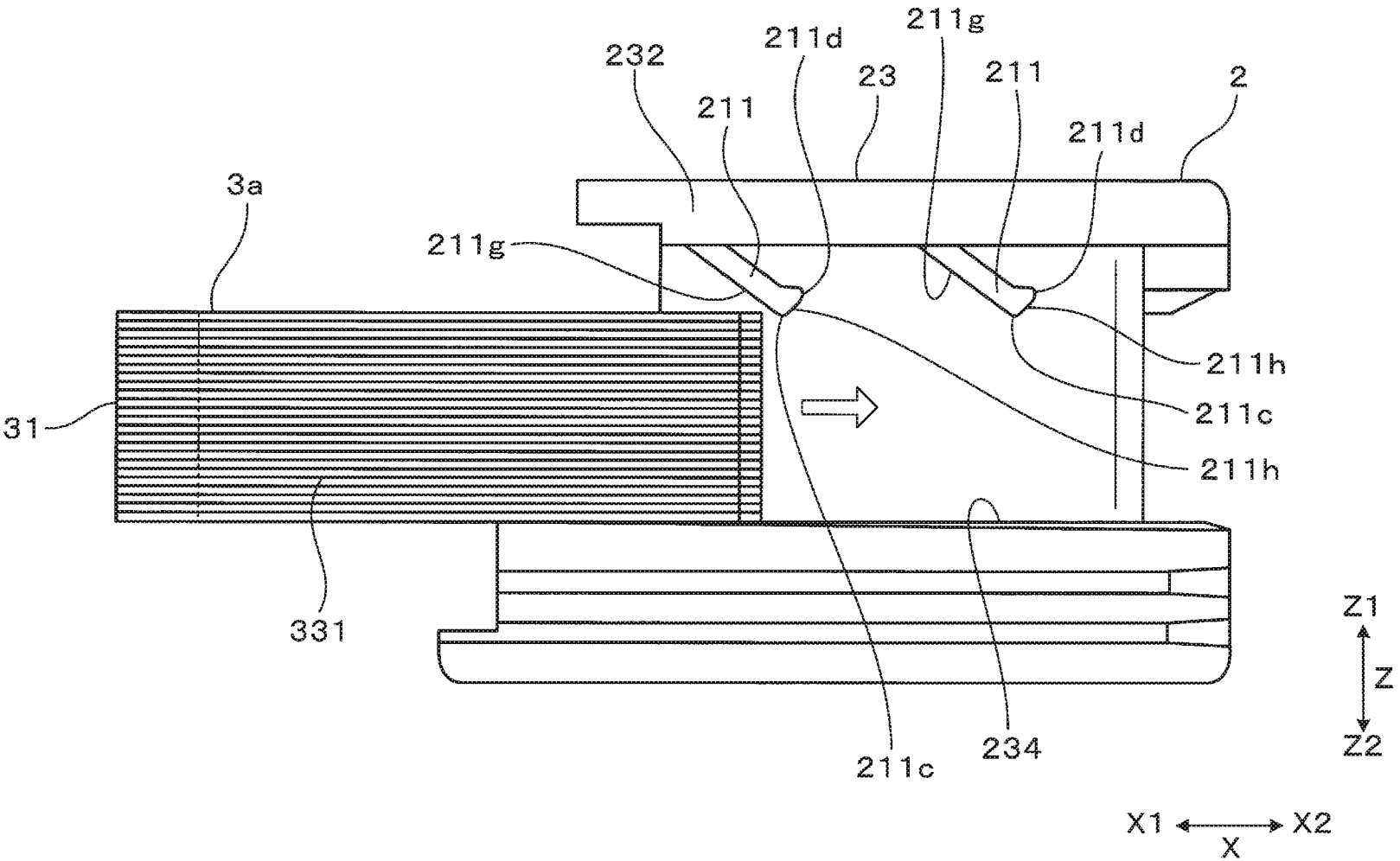
FIG. 18 is a diagram showing a state in which the first divided core is attached to the core over according to the sixth embodiment.
Figure 19:
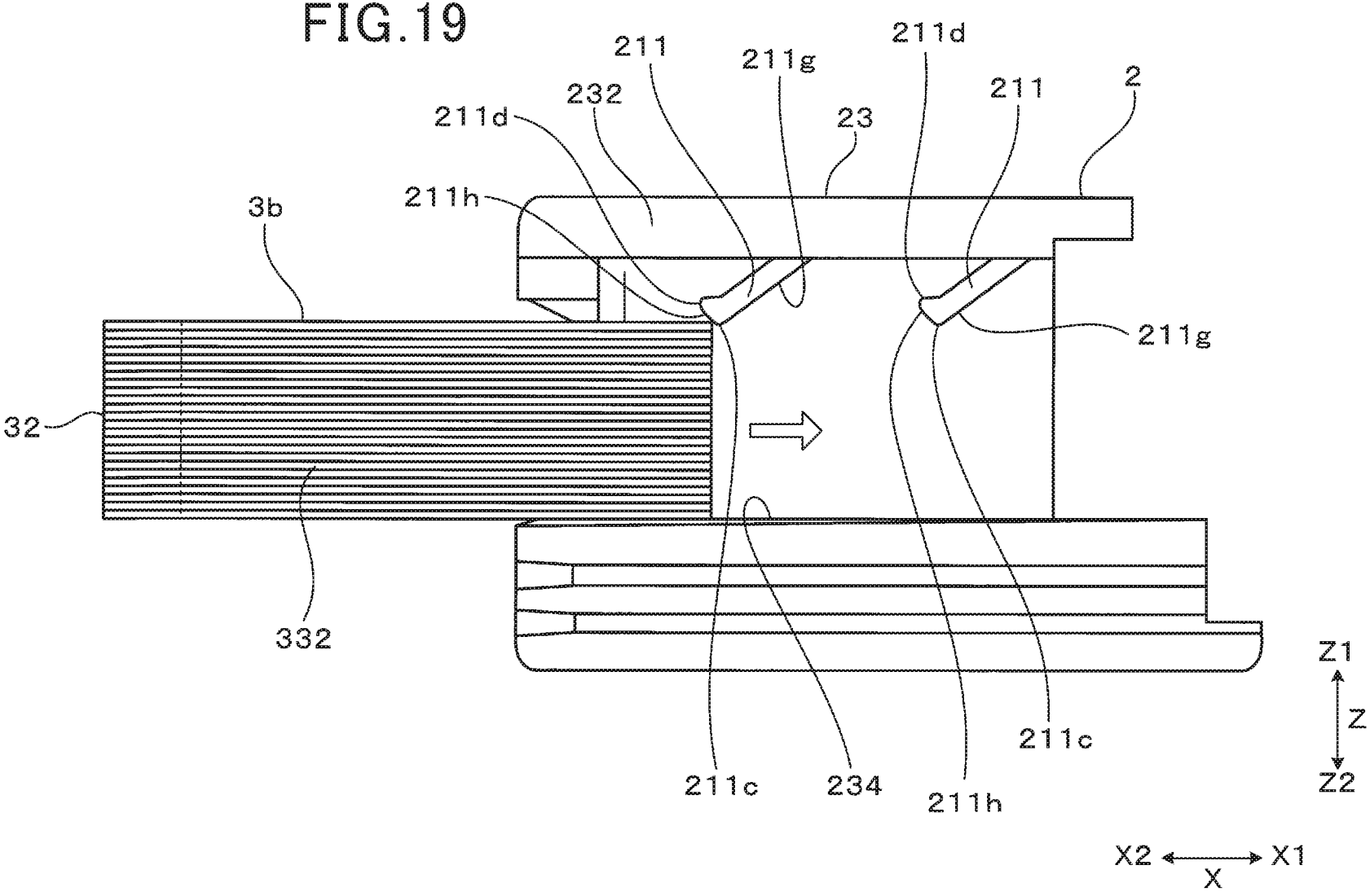
FIG. 19 is a diagram showing a state in which the second divided core is attached to the core over according to the sixth embodiment.

As shown in FIGS. 17 to 19, according to the sixth embodiment, the shape of the flexible portion 211 is changed from the first embodiment.

As shown in FIGS. 18 and 19, in the respective side cover portions 23, the flexible portion 211 is formed at two positions in the X direction. The flexible portion 211 is formed in a substantial rod-like shape. The flexible portion 211 is inclined towards the rear side X2 as it goes towards the outer peripheral core 3 side (i.e. lower side Z2) in the Z direction. Specifically, the flexible portion 211 is extended straight from the side top plate portion 232 towards an oblique direction which is inclined with respect to both of the Y direction and the Z direction.

The flexible portion 211 is provided to be connected to the side top plate portion 232 in a cantilevered state. Hence, the flexibility portion 211 is capable of being deformed in the Z direction in response to a force applied to a portion in the vicinity of the end portion located away from the side coupling portion 22*a*, and can be returned to a substantially the original state (free state) when the applied force disappears.

As shown in FIGS. 18 and 19, guide surfaces 211*g* and 211*h* are formed on the flexible portion 211. According to the present embodiment, the guide surfaces 211*g* and 211*h* are formed on both sides of the respective flexible portions 211 in the X direction. The guide surface 211*g* of the flexible portion 211 in the front side X1 is formed as a tapered surface being inclined towards the rear side X2 as it goes towards the outer peripheral core 3 side (i.e. lower side Z2) in the Z direction. The guide surface 211*h* of the flexible portion 211 in the rear side X2 is formed as a tapered surface being inclined towards the front side X1 as it goes towards the outer peripheral core 3 side (i.e. lower side Z2) in the Z direction. The guide surfaces 211*g* and 211*h* in the front and rear side of the flexible portion 211 lie in a row via the flexible contact portion 211*c*.

The protrusion 211*d* is provided in the flexible portion 211 at an end portion located protruding from the side top plate portion 232. The protrusion 211*d* protrudes towards a portion away from the flexible contact portion 211*c* in a direction orthogonal to a direction along which the flexible portion 211 protrudes from the side top plate portion 232. The protrusion 211*d* is formed, whereby the guide surface 211*h* of the flexible portion 211 in the rear side X2 is readily formed extending further towards a region in the upper side Z1.

As shown in FIG. 17, according to the present embodiment, the convex assembly 35 of the first divided core 3*a* is formed such that a part of rear surfaces in the side portions 331 and 332 protrudes in the rear side X2. The concave assembly 36 of the first divided core 3*a* is formed at an end portion opposite to the side portions 331 and 332 in the front side portion 31 such that a part of the rear surface is concaved towards the front side X1.

According to the present embodiment, the convex assembly 35 of the second divided core 3*b* is formed such that a part of the front surface of the side portions 331 and 332 protrudes in the front side X1. The concave assembly 36 of the second divided core 3*b* is formed at an end portion opposite to the side portions 331 and 332 in the rear side portion 32 such that a part of the front surface is concaved towards the rear side X2. The first divided core 3*a* and the second divided core 3*b* are assembled in the X direction from each other.

Next, an example of how to assemble the outer peripheral core 3 with the core cover 2 will be described.

As shown in FIG. 18, the first divided core 3*a* is attached to one side cover portion 23 of the core cover 2. That is, the side portion 331 of the first divided core 3*a* is inserted towards the rear side X2 from the front side X1 to be positioned between the side rib 234 of the side cover portion 3 and the flexible portion 211. At this moment, the lower surface of the side portion 331 slide on the upper surface of the side rib 234, and making a corner portion of the upper portion of the side portion 331 come into contact with the guide surface 211*g* of the flexible portion 211 in the front side X1.

In this state, the first divided core 3*a* is further put towards the rear side X2. Thus, the guide surface 211*g* of the flexible portion 211 in the front side X1 slides on the corner portion of the side portion 331 and is elastically deformed towards the upper side Z1. Thus, an interval between the flexible portion 211 and the side rib 234 is expanded in the Z direction, and the outer peripheral core 3 is inserted between the flexible portion 211 and the side rib 234.

As shown in FIG. 19, for assembling the second divided core 3*b* with the core cover 2, the second divided core 3*b* is inserted towards the front side X1 from the rear side X2 to be positioned between the flexible portion 211 of the side cover portion 23 which does not support the first divided core 3*a* and the side rib 234. At this moment, the lower surface of the side portion 332 slide on the upper surface of the side rib 234, and making a corner portion of the upper portion of the side portion 332 come into contact with the guide surface 211*h* of the flexible portion 211 in the rear side X2.

In this state, the second divided core 3*b* is the second divided core 3*b* is further put towards the front side X1 to have the flexible portion 211 deformed similar to the first divided core 3*a*, whereby the side portion 332 of the second divided core 3*b* is supported between the flexible portion 211 of the side cover portion 23 and the side rib 234. Other configurations are same as those in the first embodiment.

Besides according to the present embodiment, the same effects and advantages as those in the first embodiment can be obtained.

The present disclosure is not limited to the above-described embodiment, but may be applied to various embodiments without departing from the spirit of the present disclosure. For example, in the respective embodiments, a flexible portion is formed only in the upper side of the pair of support portions However, the flexible portion may be formed in the lower side support portion only, or may be provided in both of the pair of support portions. Further, a flexible portion may be formed in the rear cover portion.

(Conclusion)

The present provides an ignition coil capable of improving an assembling ability of the outer peripheral core with the core cover.

As one aspect of the present disclosure, an ignition coil is provided including a primary coil and a secondary coil magnetically coupled from each other; a core cover disposed around the primary coil and the secondary coil; and an outer peripheral core supported by the core cover. The core cover includes a pair of support portions that support the outer peripheral core, and at least one of the pair of support portions includes a flexible portion that elastically presses the outer peripheral core, the flexible portion having flexibility in an arrangement direction along which the pair of support portions is arranged.

According to the above-described ignition coil of one aspect, at least one of the pair of support portions includes a flexible portion that elastically presses the outer peripheral core, the flexible portion having a flexibility in an arrangement direction along which the pair of support portions is arranged. Hence, when assembling the core cover with the outer peripheral core, an interval between the pair of support portions can be changed by having the flexible portion deformed in the arrangement direction. Accordingly, the outer peripheral core can be reliably disposed between the pair of support portions.

As described, according to the above-described aspect, an ignition coil capable of improving an assembling ability of the outer peripheral core with the core cover can be provided.

What is claimed is:

1. An ignition coil comprising:

a primary coil and a secondary coil magnetically coupled with each other;

a core cover disposed around the primary coil and the secondary coil; and an outer peripheral core supported by the core cover, wherein the core cover includes a pair of support portions that support the outer peripheral core;

at least one of the pair of support portions includes a flexible portion that elastically presses the outer peripheral core, the flexible portion having flexibility in an arrangement direction along which the pair of support portions is arranged;

the core over includes a cover facing surface that faces the outer peripheral core; and the flexible portion includes a guide surface inclined towards a cover facing surface side or one side with respect to a direction orthogonal to the arrangement direction and parallel to the cover facing surface as it approaches an outer periphery core side in the arrangement direction.

2. The ignition coil according to claim 1, wherein if a surface portion in the outer peripheral core contacting with the flexible portion is defined as a contact surface portion, a contact position between the contact surface portion and the flexible portion is positioned at a portion farther than a central position of the contact surface portion with respect to the cover facing surface in a normal line direction of the cover facing surface.

3. The ignition coil according to claim 1, wherein the flexible portion is formed to approach towards an outer peripheral core side in the arrangement direction as it approaches one side in a surface direction orthogonal to the arrangement direction.

4. The ignition coil according to claim 1, wherein the flexible portion is formed into a curved shape from a root portion to a tip end portion thereof.

* * * * *